US011566394B2

(12) United States Patent
Takeuchi

(10) Patent No.: US 11,566,394 B2
(45) Date of Patent: Jan. 31, 2023

(54) BUILDING FOUNDATION STRUCTURE, AND CONSTRUCTION METHOD THEREFOR

(71) Applicant: TAKEUCHI CONSTRUCTION CO., LTD., Hiroshima (JP)

(72) Inventor: Kinji Takeuchi, Hiroshima (JP)

(73) Assignee: TAKEUCHI CONSTRUCTION CO., LTD., Hiroshima (JP)

( * ) Notice: Subject to any disclaimer, the term of this patent is extended or adjusted under 35 U.S.C. 154(b) by 0 days.

(21) Appl. No.: 17/309,777

(22) PCT Filed: Sep. 4, 2020

(86) PCT No.: PCT/JP2020/033581
§ 371 (c)(1),
(2) Date: Jun. 17, 2021

(87) PCT Pub. No.: WO2021/111690
PCT Pub. Date: Jun. 10, 2021

(65) Prior Publication Data

US 2022/0042271 A1 Feb. 10, 2022

(30) Foreign Application Priority Data

Dec. 2, 2019 (JP) ..... JP2019-218035

(51) Int. Cl.
*E02D 27/26* (2006.01)
*E02D 3/12* (2006.01)
*E02D 27/01* (2006.01)

(52) U.S. Cl.
CPC ..... *E02D 27/26* (2013.01); *E02D 3/123* (2013.01); *E02D 27/01* (2013.01); *E02D 2250/0023* (2013.01); *E02D 2300/002* (2013.01)

(58) Field of Classification Search
CPC ..... E02D 27/26; E02D 3/123; E02D 27/01; E02D 2250/0023; E02D 2300/002
(Continued)

(56) References Cited

U.S. PATENT DOCUMENTS 2,215,773 A * 9/1940 Workman ..... E04B 1/3416 D25/19
2,374,624 A * 4/1945 Schwendt ..... E02D 27/01 52/261

(Continued)

FOREIGN PATENT DOCUMENTS

ES 2701605 A1 * 2/2019 ..... E02D 27/02
JP H0270830 A 3/1990

(Continued)

OTHER PUBLICATIONS

International Search Report dated Nov. 24, 2020 from PCT Application No. PCT/JP2020/033581.

*Primary Examiner* — Brian D Mattei
*Assistant Examiner* — Omar F Hijaz
(74) *Attorney, Agent, or Firm* — Innovation Capital Law Group, LLP; Vic Lin

(57) ABSTRACT

A building foundation structure includes a ground improved body obtained by improving a surface layer ground, and foundation concrete placed on the ground improved body on site. The foundation concrete located below a building pillar has an upper part and a lower part having different shapes. The lower part has a reverse trapezoidal sectional shape in a cross section taken along a vertical plane including a horizontal direction perpendicular to a horizontal line connecting building pillars adjacent to each other. The upper part has a brim portion protruding in the first horizontal direction from a side edge at an upper end in the sectional shape of the lower part.

10 Claims, 13 Drawing Sheets

(58) Field of Classification Search
USPC ..... 52/166, 169.9, 170, 274, 292, 52/293.1–293.4, 294–297
See application file for complete search history.

(56) References Cited

U.S. PATENT DOCUMENTS 4,918,891 A * 4/1990 Gerszewski ..... E02D 27/02 52/741.15
5,217,326 A * 6/1993 Bullivant ..... E02D 27/01 52/294
5,746,036 A * 5/1998 Angelette ..... E02D 27/42 52/294
6,431,797 B2 * 8/2002 Greenberg ..... E02D 29/0283 405/262
7,302,778 B2 * 12/2007 MacMillan ..... E04H 12/2269 52/294
8,955,276 B2 * 2/2015 Wall ..... E04F 15/02464 52/126.5
2013/0000236 A1 * 1/2013 Gallardo Hernandez ..... F03D 13/22 52/297
2015/0121784 A1 * 5/2015 Abad Huber ..... E02D 27/016 52/297
2020/0240099 A1 * 7/2020 Huo ..... F03D 13/20
2021/0395970 A1 * 12/2021 Montaner Fraguet .. F03D 13/22

FOREIGN PATENT DOCUMENTS

JP 2004060290 A 2/2004
JP 3608568 B1 1/2005
JP 2008280828 A 11/2008
JP 2009174181 A 8/2009
JP 5494880 B1 5/2014
JP 2018021418 A 2/2018
JP 2018091047 A 6/2018
JP 6436256 B1 12/2018
KR 100851837 B1 8/2008
RU 2379425 C1 * 1/2010

* cited by examiner

BUILDING FOUNDATION STRUCTURE, AND CONSTRUCTION METHOD THEREFOR

TECHNICAL FIELD

The present invention relates to: a building foundation structure including a ground improved body obtained by improving a surface layer ground, and foundation concrete placed on the ground improved body on site; and a construction method therefor.

BACKGROUND ART

There has been known a building foundation structure including a ground improved body obtained by improving a surface layer ground, and foundation concrete placed on the ground improved body on site (see, for example, Patent Literatures 1 to 3). Such a building foundation structure has features that: construction cost is reduced with a simple structure; a support force of the entire foundation can be improved while differential settlement can be suppressed; and liquefaction of sediment at the time of an earthquake is effectively inhibited by a ground covering effect, for example.

In the building foundation structures of Patent Literatures 1 and 2, the shape of a lower surface of foundation concrete located below a building pillar is a square, and the shape of the foundation concrete is a rectangular parallelepiped (square prism) (see an engagement projection 7*a* in FIG. 5 of Patent Literature 1 and a building foundation 3 in FIG. 1 of Patent Literature 2).

In the building foundation structure of Patent Literature 3, a bottom surface of foundation concrete located below a building pillar has a four-or-more-sided polygonal shape smaller than a plan shape of the foundation concrete. Further, a part of a lower surface of the foundation concrete other than the bottom surface is a slope surface connecting the bottom surface and the plan shape, and a slope angle of the slope surface from a horizontal plane is not less than 20° and not greater than 40° (see foundation concrete 3 in FIG. 2 of Patent Literature 3).

In the building foundation structure of Patent Literature 3, stress transferred to the lower ground can be reduced owing to the shape of the foundation concrete. In addition, the placing amount of foundation concrete can be reduced and thus construction cost can be reduced.

CITATION LIST

Patent Literature 1—Japanese Patent No. 3608568
Patent Literature 2—Japanese Patent No. 5494880
Patent Literature 3—Japanese Patent No. 6436256

SUMMARY OF THE INVENTION

Problems to be Solved by the Invention

The present inventor has attempted to make further improvement in the building foundation structure of Patent Literature 3 which provides the above effects, and has further revised the shape of the foundation concrete located below the building pillar.

An object to be achieved by the present invention is to, in a building foundation structure including a ground improved body obtained by improving a surface layer ground, and foundation concrete placed on the ground improved body on site, and a construction method therefor, reduce stress transferred to a lower ground, and reduce construction cost by reducing the placing amount of the foundation concrete, thus making further improvement.

Solution to the Problems

To achieve the above object, the present invention provides a building foundation structure and a construction method therefor as described below.

The summary of the present invention is as follows.

[1] A building foundation structure according to the present invention includes a ground improved body obtained by improving a surface layer ground, and foundation concrete placed on the ground improved body on site. The foundation concrete directly supports building steel pillars or a building reinforced concrete wall. The foundation concrete has an upper part and a lower part having shapes different from each other. The lower part has a reverse trapezoidal sectional shape in a cross section taken along a vertical plane including a first horizontal direction perpendicular to a horizontal line connecting the building steel pillars adjacent to each other, or a cross section taken along a vertical plane including a second horizontal direction perpendicular to the building reinforced concrete wall. The upper part has a brim portion protruding in the first horizontal direction or a brim portion protruding in the second horizontal direction, from a side edge at an upper end in the sectional shape of the lower part. A thickness of the brim portion is not less than 0.05 m and not greater than 0.3 m. A protruding length of the brim portion is not less than 0.1 m and not greater than 0.6 m. The protruding length of the brim portion is 1 to 4 times the thickness of the brim portion.

[2] In the building foundation structure described in [1], a slope angle of a side surface of the reverse trapezoidal sectional shape from a horizontal plane is not less than 20° and not greater than 40°.

[3] In the building foundation structure described in [1] or [2], the foundation concrete is individual footing, the lower part has a bottom surface having a four-or-more-sided polygonal shape smaller than a plan shape of an outer periphery at an upper end of the lower part, and the lower part has a side surface which is a slope surface connecting the outer periphery at the upper end of the lower part and an outer periphery of the bottom surface.

[4] A construction method for a building foundation structure according to the present invention is a construction method for a building foundation structure that includes a ground improved body obtained by improving a surface layer ground, and foundation concrete placed on the ground improved body on site. The foundation concrete directly supports building steel pillars or a building reinforced concrete wall. The foundation concrete has an upper part and a lower part having shapes different from each other. The lower part has a reverse trapezoidal sectional shape in a cross section taken along a vertical plane including a first horizontal direction perpendicular to a horizontal line connecting the building steel pillars adjacent to each other, or a cross section taken along a vertical plane including a second horizontal direction perpendicular to the building reinforced concrete wall. The upper part has a brim portion protruding in the first horizontal direction or a brim portion protruding in the second horizontal direction, from a side edge at an upper end in the sectional shape of the lower part. A thickness of the brim portion is not less than 0.05 m and not greater than 0.3 m. A protruding length of the brim portion is not less than 0.1 m and not greater than 0.6 m. The protruding length of the brim portion is 1 to 4 times the thickness of the brim portion. The construction method includes a ground improvement step, a foundation excavation step, and a foundation placing step. The ground improvement step is a step of backfilling soil obtained by digging the surface layer ground down, mixing and stirring the soil while adding and mixing a solidification material, and then performing compaction to form the ground improved body. The foundation excavation step includes a step of excavating an upper part of the ground improved body located below a building pillar or below a building wall, into the shape of the upper part of the foundation concrete, to form an upper excavated portion, and a step of excavating a part below the upper excavated portion into the shape of the lower part of the foundation concrete, to form a lower excavated portion. The foundation placing step is a step of placing leveling concrete into the lower excavated portion, performing foundation reinforcing bar arrangement in the upper excavated portion and the lower excavated portion, and placing the foundation concrete.

[5] In the construction method for the building foundation structure described in [4], a slope angle of a side surface of the reverse trapezoidal sectional shape from a horizontal plane is not less than 20° and not greater than 40°.

Advantageous Effects of the Invention

In the building foundation structure and the construction method therefor according to the present invention as described above, the foundation concrete placed on site on the ground improved body obtained by improving the surface layer ground has the upper part and the lower part having shapes different from each other. The lower part has a reverse trapezoidal sectional shape and the upper part has the brim portion protruding in the horizontal direction.

Owing to the above shape of the foundation concrete, the range in which stress is transferred from the foundation concrete to the lower ground is broadened, whereby stress transferred to the lower ground can be reduced, and in addition, the volume of the foundation concrete is reduced, whereby the placing amount of the foundation concrete can be reduced and thus construction cost can be reduced.

Moreover, since the foundation concrete has the brim portion, the ground contact pressure at an end of the foundation concrete is dispersed when a moment load is applied to the foundation concrete. Thus, the maximum ground contact pressure applied to one end underneath the foundation concrete can be reduced.

DESCRIPTION OF EMBODIMENTS

Hereinafter, embodiments according to the present invention will be described with reference to the drawings.

Embodiment 1

Figure 1A:
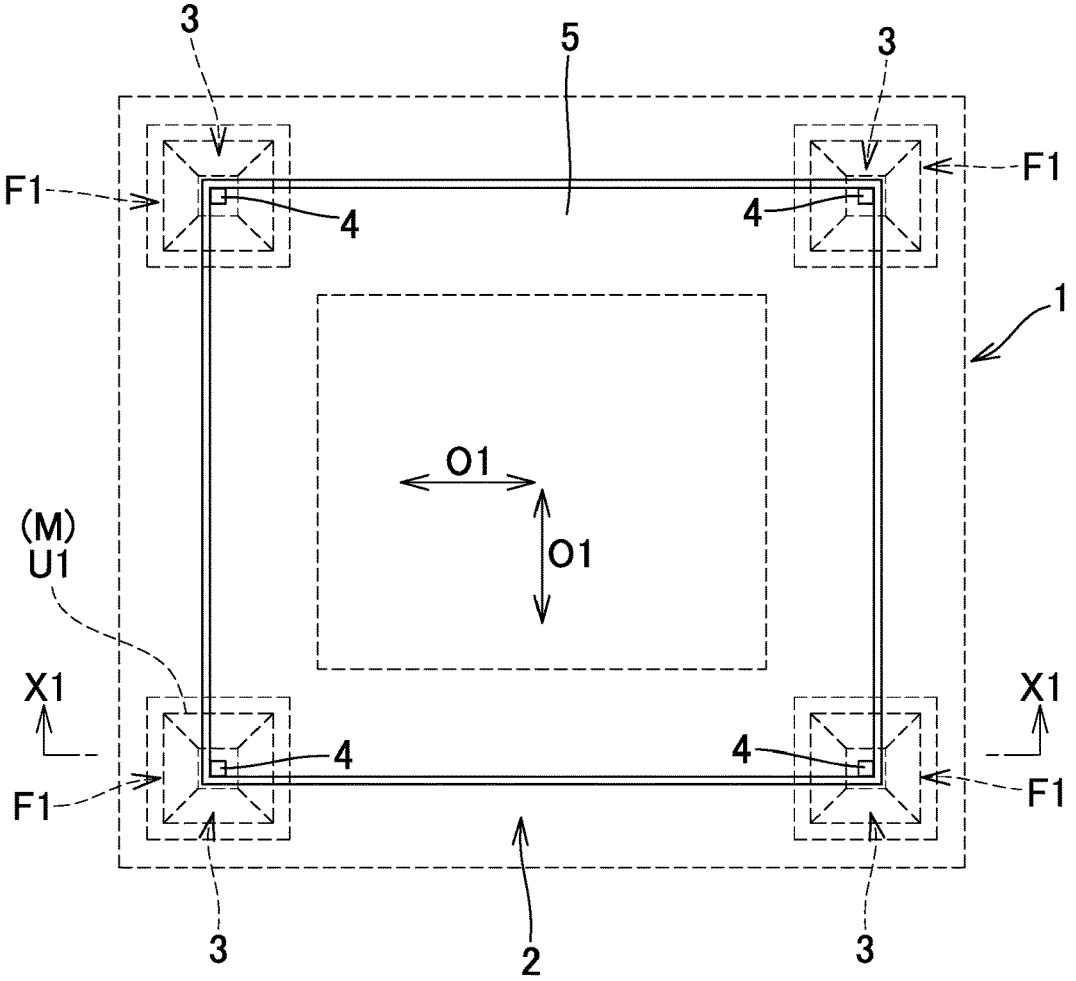
FIG. 1A is a plan view showing a building foundation structure according to embodiment 1 of the present invention.
Figure 1B:
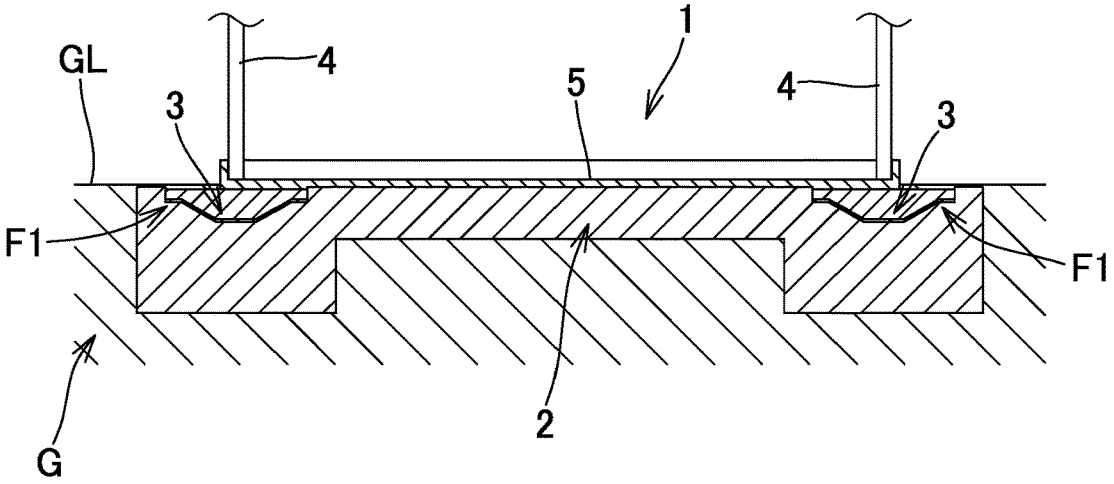
FIG. 1B is a sectional view taken along arrows X1-X1 in FIG. 1A.
Figure 2:
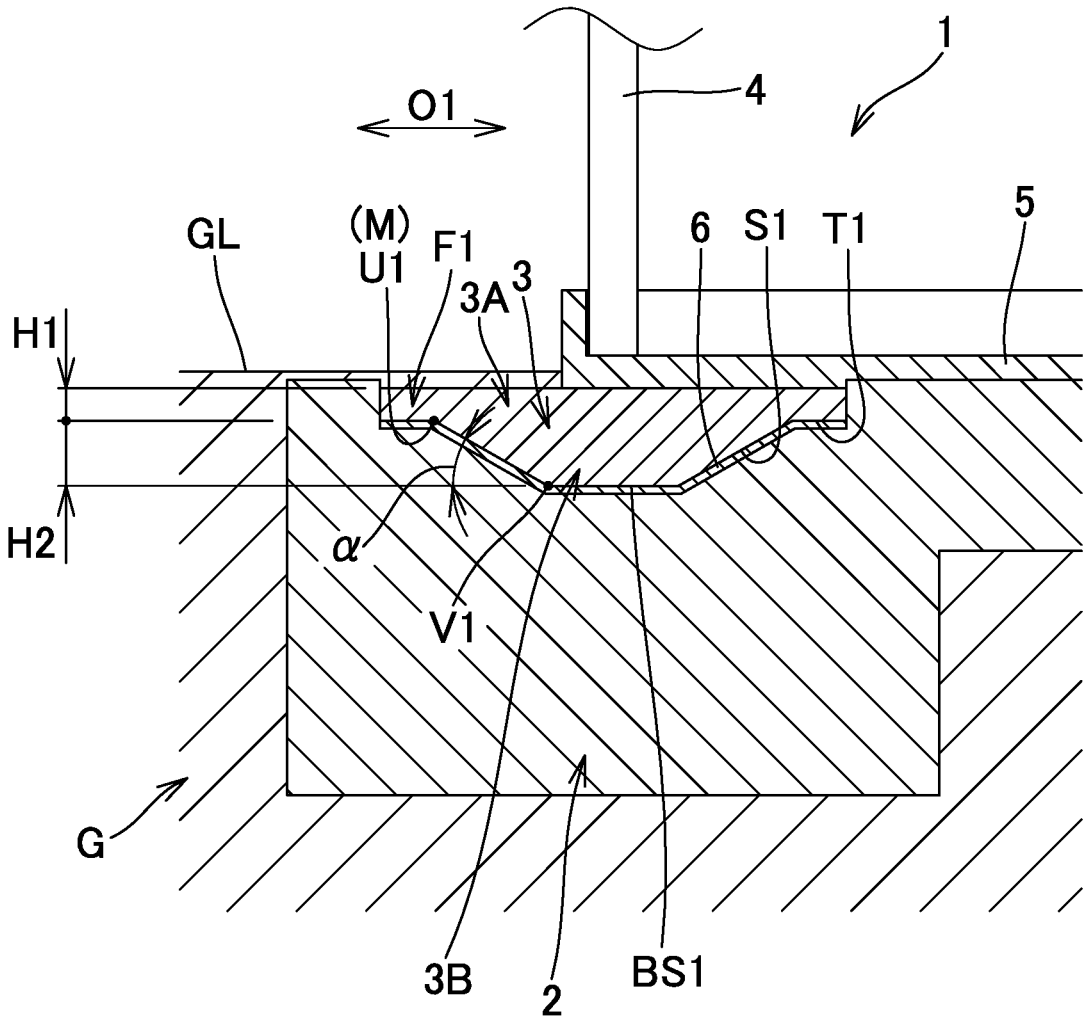
FIG. 2 is an enlarged view of a major part in FIG. 1B.

A plan view in FIG. 1A and sectional views in FIG. 1B and FIG. 2 show a building foundation structure 1 according to embodiment 1 of the present invention.

The building foundation structure 1 includes a ground improved body 2 obtained by improving a surface layer ground G, and foundation concrete 3 placed on the ground improved body 2 on site.

The foundation concrete 3 is individual footing, and has an upper part 3A and a lower part 3B having shapes different from each other.

The lower part 3B of the foundation concrete 3 has a reverse trapezoidal sectional shape in a cross section taken along a vertical plane including a first horizontal direction O1 perpendicular to a horizontal line connecting building pillars 4 adjacent to each other. In the present embodiment, the shape of the lower part 3B of the foundation concrete 3 is a reverse quadrangular frustum shape.

The plan shape of an outer periphery U1 at the upper end of the lower part 3B is a square. The plan shape of a bottom surface BS1 of the lower part 3B is a square smaller than the plan shape of the outer periphery U1 at the upper end of the lower part 3B. A side surface S1 of the lower part 3B is a slope surface connecting the outer periphery U1 at the upper end of the lower part 3B and an outer periphery V1 of the bottom surface BS1. It is preferable that a slope angle $\alpha$ of the side surface (the side surface of the reverse trapezoidal sectional shape) S1 which is the slope surface, from the horizontal plane, is set in a range of $20° \leq \alpha \leq 40°$.

The upper part 3A of the foundation concrete 3 has a brim portion F1 protruding in the first horizontal direction O1 from a side edge M (outer periphery U1) at the upper end in the sectional shape of the lower part 3B. A lower surface T1 of the brim portion F1 is a substantially horizontal surface.

Next, an example of a construction process for the building foundation 1 will be described.

Ground Improvement Step

A. Dig-Down Step

The surface layer ground G below a ground level GL shown in FIG. 1B and FIG. 2 is dug down in a desired shape by, for example, plowing using a backhoe.

B. Primary Improvement Step

Next, a primary improvement step is performed as follows. A backhoe, for example, to which a mixing fork is mounted as an attachment, is used to perform excavation on the ground into a square shape which corresponds to the lower-part shape of the ground improved body 2. Then, mixing and stirring are performed while a solidification material such as a cement-based solidification material is added and mixed, and compaction is performed by a heavy machine and a roller, etc., to form the lower part of the ground improved body 2.

C. Secondary Improvement Step

Next, a secondary improvement step is performed as follows. The soil obtained by digging in the dig-down step is backfilled to the upper side of the lower part of the ground improved body 2 by a backhoe or the like. Then, a backhoe, for example, to which a mixing fork is mounted as an attachment, is used to excavate the surface layer ground G from the ground level GL into the upper-part shape of the ground improved body 2. Then, mixing and stirring are performed while a solidification material is added and mixed, and compaction is performed by a heavy machine and a roller, etc., to form the upper part of the ground improved body 2.

Foundation Excavation Step

A. Upper Excavated Portion Forming Step

Figure 3A:
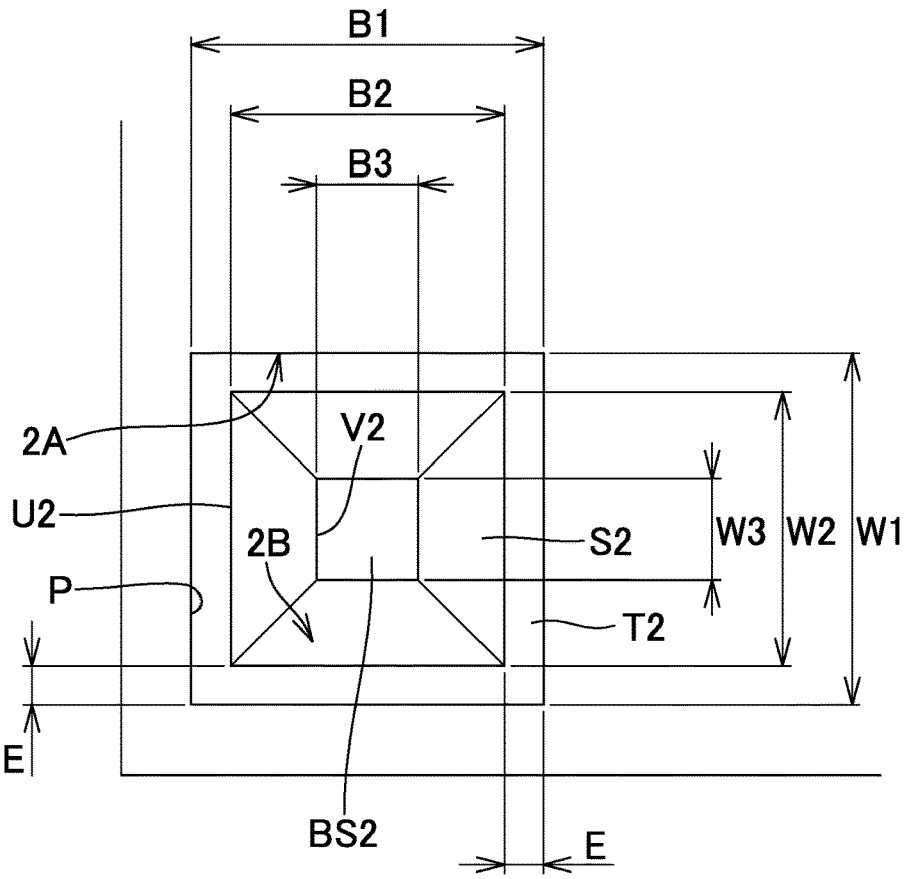
FIG. 3A is a plan view showing a state in which, in a foundation excavation step, an upper excavated portion and a lower excavated portion are formed in a ground improved body formed in a ground improvement step, in a construction method for the building foundation structure according to embodiment 1.
Figure 3B:
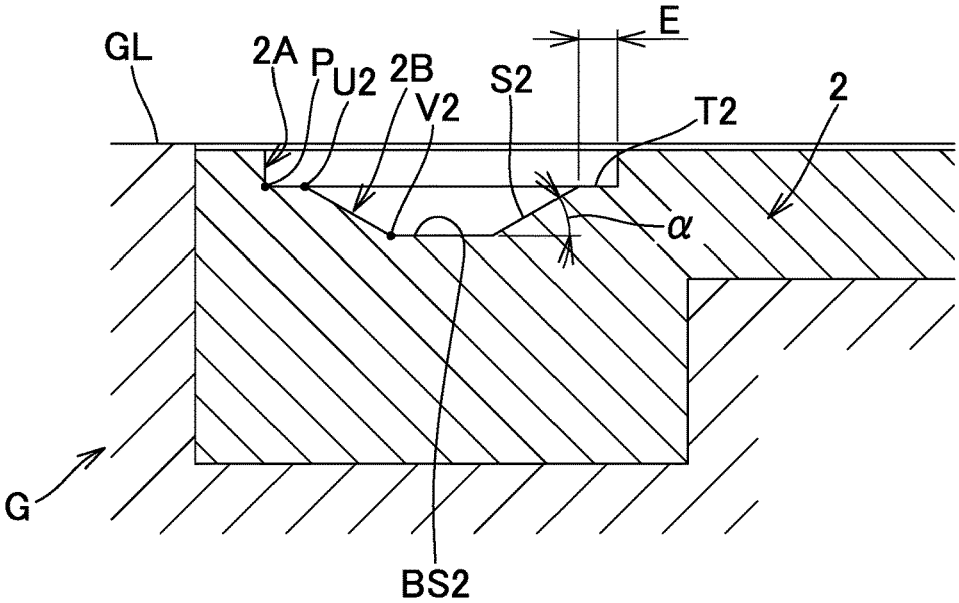
FIG. 3B is a sectional view of FIG. 3A.

Next, with respect to the ground improved body 2 formed in the ground improvement step, the upper part of the ground improved body 2 located below the above-ground part of each steel pillar 4 shown in FIG. 1A, FIG. 1B, and FIG. 2 is excavated to a position of a lower end outer periphery P, to form an upper excavated portion 2A, as shown in a plan view in FIG. 3A and a sectional view in FIG. 3B. That is, the above-mentioned upper part is excavated to a position of a lower surface T2 (FIG. 3B) at a predetermined depth, into a rectangular parallelepiped shape in a range of a transverse width B1 and a longitudinal width W1 shown in FIG. 3A, by a backhoe or the like, to form the upper excavated portion 2A.

B. Lower Excavated Portion Forming Step

Next, from a periphery U2 located inward by a protruding length E of the brim portion F1 from the lower end outer periphery P, excavation is performed in a reverse quadrangular frustum shape so that a bottom surface BS2 has a square shape, to form a lower excavated portion 2B. For example, the lower excavated portion 2B is formed by performing excavation to a predetermined depth, i.e., to an outer periphery V2 of the bottom surface BS2, into a rectangular parallelepiped shape in a range of a transverse width B3 and a longitudinal width W3 shown in FIG. 3A, by a backhoe or the like, and then performing excavation so as to form side surfaces S2 which are slope surfaces in a reverse quadrangular frustum shape shown in FIG. 3B.

Foundation Placing Step

Then, leveling concrete 6 shown in FIG. 2 is placed into the lower excavated portion 2B.

Next, a pedestal anchor bolt for fixing the steel pillar 4 is fixed to the leveling concrete 6, foundation reinforcing bar arrangement is performed in the upper excavated portion 2A and the lower excavated portion 2B, and foundation concrete 3 is placed. An upper part 3A (range of height H1 in FIG. 2) of the foundation concrete 3 is formed in a rectangular parallelepiped shape, and a lower part 3B (range of height H2 in FIG. 2) of the foundation concrete 3 is formed in a reverse quadrangular frustum shape.

Subsequently, the steel pillar 4 is installed and floor concrete 5 is placed.

Through the above process, construction of the building foundation (understructure) 1 shown in FIG. 1A and FIG. 1B is completed.

Confirmation of Effects Through Numerical Analysis

Next, numerical analysis performed for confirming effects will be described.

A. Analysis Method

A numerical analysis is performed using ground finite element method (FEM) analysis software (PLAXIS).

(1) As a first analysis, analysis is performed on Comparative example 1 in which foundation concrete has a rectangular parallelepiped shape, Comparative example 2 in which an upper part of foundation concrete has a rectangular parallelepiped shape and a lower part thereof has a reverse quadrangular frustum shape, and Examples 1 to 5 corresponding to the shape in embodiment 1 of the present invention in which foundation concrete has the brim portion.

(2) As a second analysis, analysis is performed on Examples 6 to 8 in which the protruding length E of the brim portion F1 is fixed (E=0.2 m) and the ratio (E/H1) of the protruding length E of the brim portion F1 to a thickness H1 of the brim portion F1 is changed, in the shape of embodiment 1 of the present invention.

(3) As a third analysis, analysis is performed on Examples 9 to 13 in which the thickness H1 of the brim portion F1 is fixed (H1=0.1 m) and the ratio (E/H1) of the protruding length E of the brim portion F1 to the thickness H1 of the brim portion F1 is changed, in the shape of embodiment 1 of the present invention.

B. Analysis Models of Examples and Comparative Examples

Figure 4A:
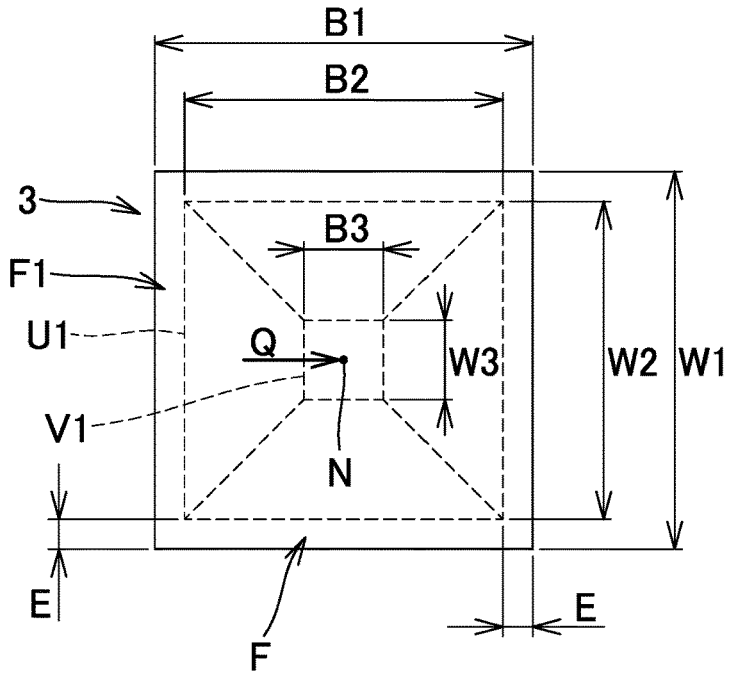
FIG. 4A is a plan view showing a finite-element-method (FEM) analysis model of ground (hereinafter referred to as "ground FEM analysis model).
Figure 4B:
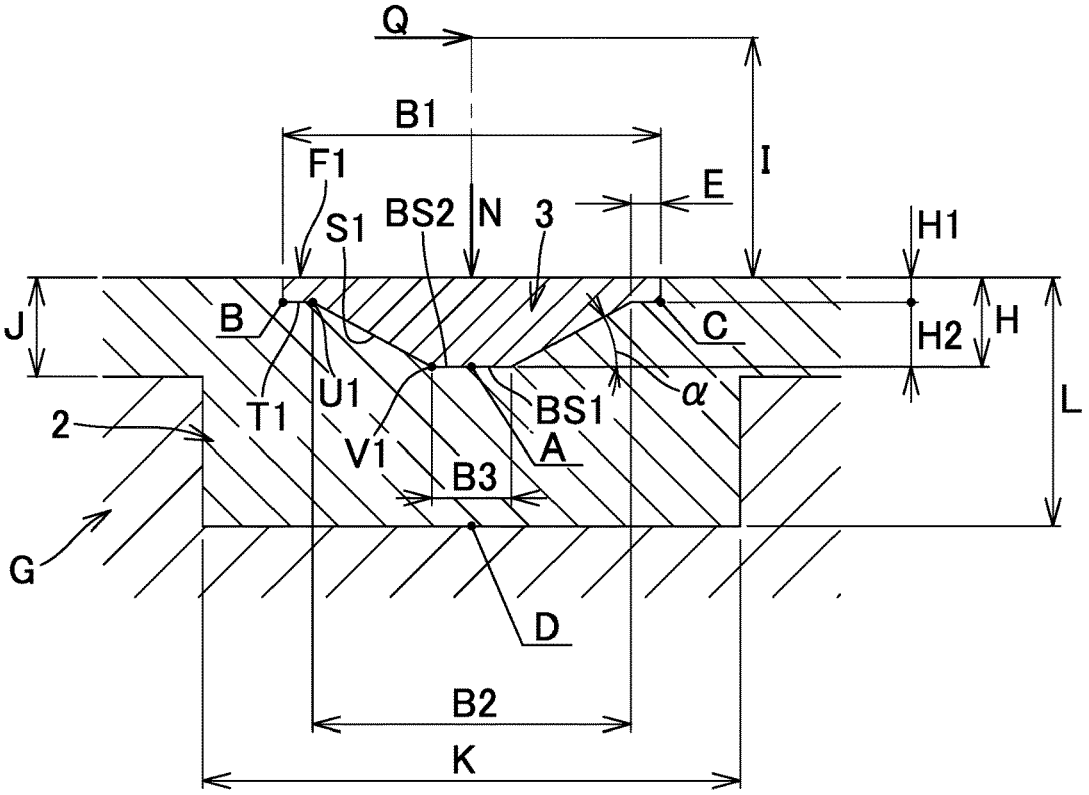
FIG. 4B is a sectional view showing the ground FEM analysis model.
Figure 5A:
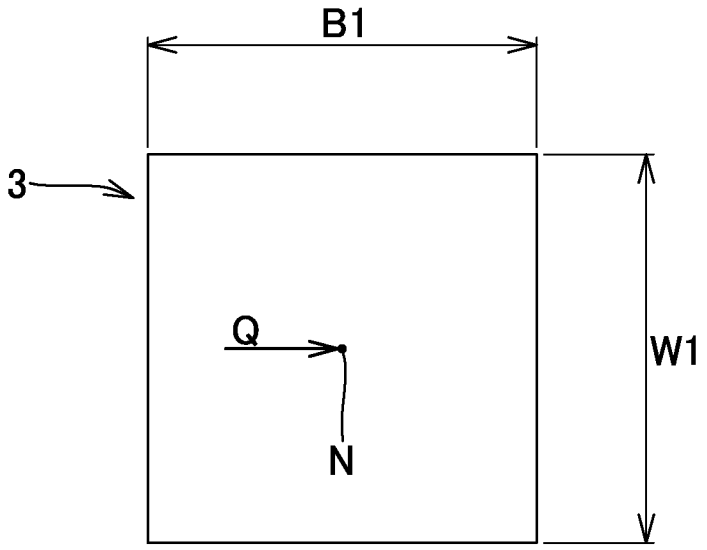
FIG. 5A PRIOR ART
FIG. 5A is a plan view showing a ground FEM analysis model in Comparative example 1.
Figure 5B:
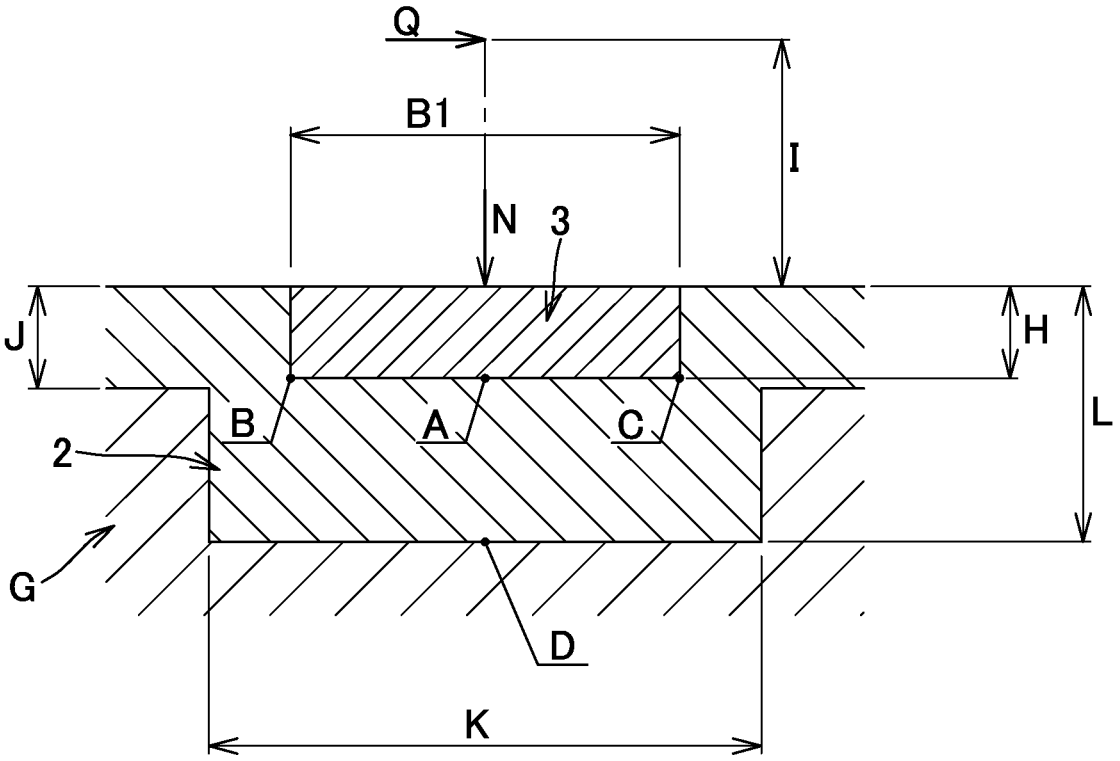
FIG. 5B PRIOR ART
FIG. 5B is a sectional view showing the ground FEM analysis model in Comparative example 1.
Figure 6A:
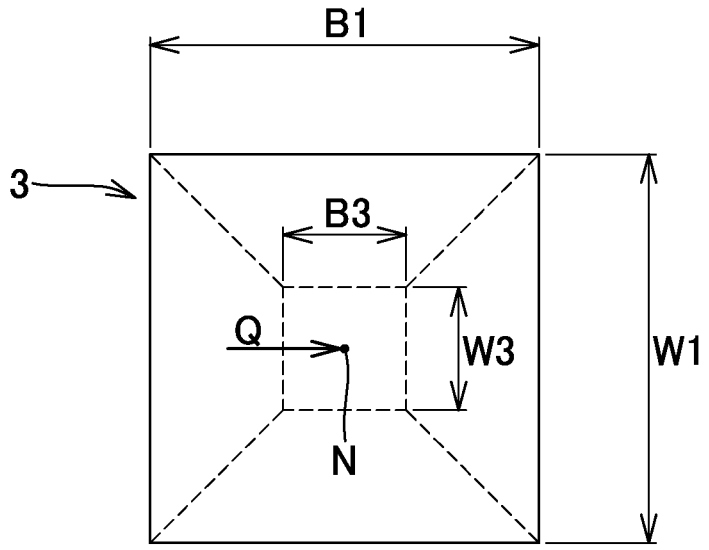
FIG. 6A PRIOR ART
FIG. 6A is a plan view showing a ground FEM analysis model in Comparative example 2.
Figure 6B:
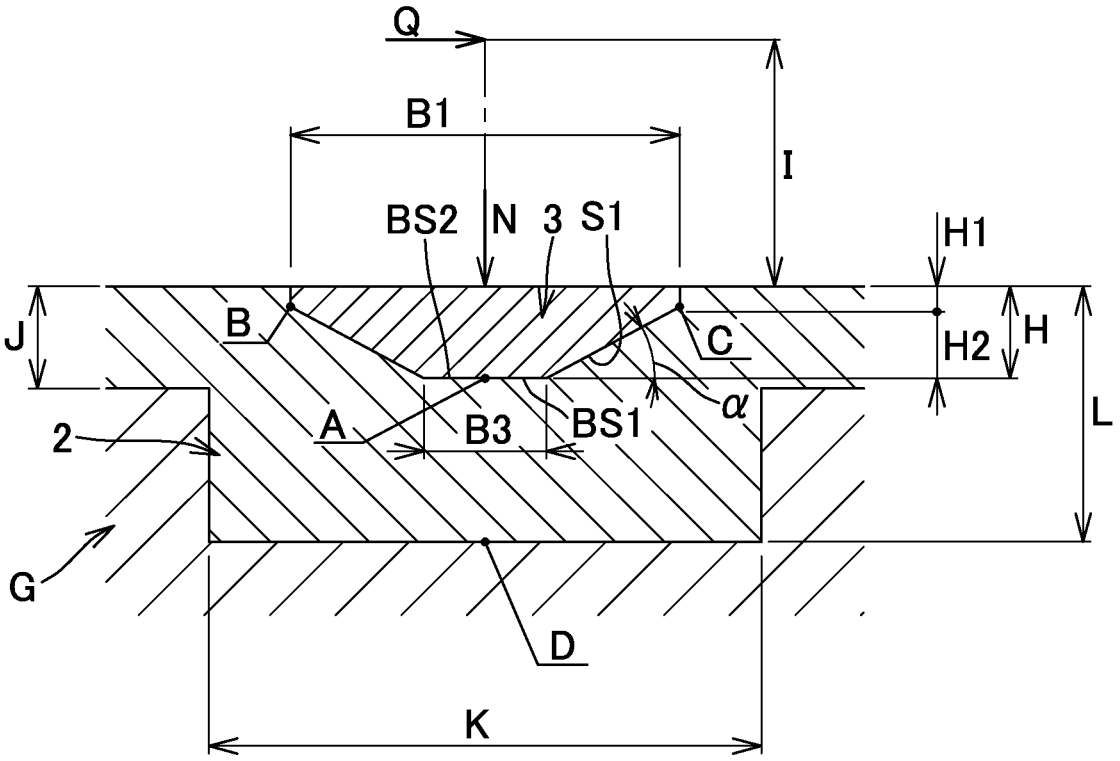
FIG. 6B PRIOR ART
FIG. 6B is a sectional view showing the ground FEM analysis model in Comparative example 2.

An analysis model of Examples is shown in a plan view in FIG. 4A and a sectional view in FIG. 4B, an analysis model of Comparative example 1 is shown in a plan view in FIG. 5A and a sectional view in FIG. 5B, and an analysis model of Comparative example 2 corresponding to a building foundation structure of Patent Literature 3 is shown in a plan view in FIG. 6A and a sectional view in FIG. 6B.

First Analysis

A. Parameters (1) An improvement thickness L is set to 2.5 m, a secondary improvement thickness J is set to 1.0 m, and a primary improvement width K is set to 5.6 m.

(2) A foundation height H is set to 0.9 m, and the foundation transverse width B1 and the foundation longitudinal width W1 are set to 4.0 m.

(3) In Comparative example 2 and Examples 1 to 5, the slope angle α of the slope surface S1 (the side surface of the reverse trapezoidal sectional shape) from the horizontal plane is set to about 30°.

(4) In Comparative example 2, the transverse width B3 of the foundation bottom surface BS1 and the longitudinal width W3 of the foundation bottom surface BS1 are set to 1.4 m.

(5) In Examples 1 to 5, the transverse width B3 of the foundation bottom surface BS1 and the longitudinal width W3 of the foundation bottom surface BS1 are set to 0.8 m.

(6) In Examples 1 to 5 having the brim portion F1, the ratio (E/H1) of the protruding length E of the brim portion F1 to the thickness H1 of the brim portion F1 which is the height of the upper part 3A of the foundation concrete 3, is set to 2.

The values of H1, H2, B2, W2, E are set as follows.

(1) Comparative example 2: H1=0.2 m, H2=0.7 m (2) Example 1: H1=0.1 m, H2=0.8 m, B2=W2=3.6 m, E=0.2 m (3) Example 2: H1=0.15 m, H2=0.75 m, B2=W2=3.4 m, E=0.3 m (4) Example 3: H1=0.2 m, H2=0.7 m, B2=W2=3.2 m, E=0.4 m (5) Example 4: H1=0.25 m, H2=0.65 m, B2=W2=3.0 m, E=0.5 m (6) Example 5: H1=0.3 m, H2=0.6 m, B2=W2=2.8 m, E=0.6 m B. Load Conditions In Patent Literature 3, only a load of 900 kN is used which corresponds to the dead load and the live load that are long-term loads, as an external force, in numerical analysis on the building foundation structure, for confirming its effects (see paragraph [0025] in Patent Literature 3).

Actually, an earthquake force and a wind force as short-term loads are also applied to a building. The earthquake force and the wind force act so as to shake the building sideways, and therefore a horizontal force is also applied to the building. Thus, a horizontal force and a moment load corresponding to short-term loads, as well as long-term loads, are applied to the foundation structure.

Accordingly, in the numerical analysis, the following load conditions are set: a load condition 1 corresponding to long-term loads, a load condition 2 corresponding to a state in which a middle earthquake (horizontal acceleration: about 200 gal) occurs, and a load condition 3 corresponding to a state in which a large earthquake (horizontal acceleration: about 400 gal) occurs.

That is, in the analysis models shown in the plan view in FIG. 4A and the sectional view in FIG. 4B, the plan view in FIG. 5A and the sectional view in FIG. 5B, and the plan view in FIG. 6A and the sectional view in FIG. 6B, a vertical load N and a horizontal load Q applied to the foundation concrete 3 are set as follows.

(1) Load condition 1: N=1100 kN (2) Load condition 2: N=1100 kN, Q=220 kN (I=3 m)

(3) Load condition 3: N=1100 kN, Q=440 kN (I=3 m)

C. Evaluation Items

Evaluation items are principal stresses (kN/m$^2$) at points A to C underneath the foundation concrete 3, a ground contact pressure (kN/m$^2$) at a point D underneath the ground improved body 2, and a concrete amount (m$^3$) which is the volume of the foundation concrete 3, as shown in FIG. 4B, FIG. 5B, and FIG. 6B.

D. Analysis Result

Table 1 shows an analysis result for the load condition 1, Table 2 shows an analysis result for the load condition 2, and Table 3 shows an analysis result for the load condition 3.

Table 1 is provided below:

TABLE 1

| Comparative example/Example | | Shape of foundation concrete: "Plan shape" / "Bottom surface shape" (Magnitude relation) | Presence/ absence of brim portion | Parameter/load condition/evaluation item: L | H | H1 | H2 | B1 | W1 | B2 | W2 | B3 | W3 | E | E/H1 | α (°) |
|---|---|---|---|---|---|---|---|---|---|---|---|---|---|---|---|---|
| | | | | (m) | | | | | | | | | | | | |
| Comparative example 1 | FIG. 5A, FIG. 5B | Square = Square | Absent | 2.5 | 0.9 | — | — | 4.0 | 4.0 | — | — | — | — | — | — | — |
| Comparative example 2 | FIG. 6A, FIG. 6B | Square > Square | Absent | | | 0.2 | 0.7 | | | — | — | 1.4 | 1.4 | — | — | 30 |
| Example 1 | FIG. 4A, | | Present | | | 0.1 | 0.8 | | | 3.6 | 3.6 | 0.8 | 0.8 | 0.2 | 2 | |
| Example 2 | FIG. 4B | | | | | 0.15 | 0.75 | | | 3.4 | 3.4 | | | 0.3 | | |
| Example 3 | | | | | | 0.2 | 0.7 | | | 3.2 | 3.2 | | | 0.4 | | |
| Example 4 | | | | | | 0.25 | 0.65 | | | 3.0 | 3.0 | | | 0.5 | | |
| Example 5 | | | | | | 0.3 | 0.6 | | | 2.8 | 2.8 | | | 0.6 | | |

| Comparative example/Example | | Parameter/load condition/evaluation item: Load condition 1 (kN) | Principal stress underneath foundation concrete (kN/m$^2$): Point A | Point B | Point C | Ground contact pressure underneath improved body (kN/m$^2$): Point D | Concrete amount (m$^3$) |
|---|---|---|---|---|---|---|---|
| Comparative example 1 | FIG. 5A, FIG. 5B | Long-term load N = 1100 | 95.2 | 100.7 | 101.4 | 106.8 | 14.4 |
| Comparative example 2 | FIG. 6A, FIG. 6B | | 100.8 | 83.9 | 84.1 | 100.4 | 8.7 |

TABLE 1-continued

| | | | | | | |
|---|---|---|---|---|---|---|
| Example 1 | FIG. 4A, | 101.4 | 92.7 | 93.4 | 97.6 | 6.0 |
| Example 2 | FIG. 4B | 101.0 | 93.4 | 92.1 | 98.2 | 6.1 |
| Example 3 | | 100.5 | 94.3 | 94.1 | 98.8 | 6.3 |
| Example 4 | | 100.0 | 94.1 | 94.7 | 99.4 | 6.6 |
| Example 5 | | 99.6 | 92.0 | 91.9 | 100.0 | 6.9 |

Table 2 is provided below:

TABLE 2

| Comparative example/Example | | Shape of foundation concrete: "Plan shape" "Bottom surface shape" (Magnitude relation) | Presence/ absence of brim portion | Parameter/load condition/evaluation item: L | H | H1 | H2 | B1 | W1 | B2 | W2 | B3 | W3 | E | E/H1 | α (°) |
|---|---|---|---|---|---|---|---|---|---|---|---|---|---|---|---|---|
| | | | | (m) | | | | | | | | | | | | |
| Comparative example 1 | FIG. 5A, FIG. 5B | Square = Square | Absent | 2.5 | 0.9 | — | — | 4.0 | 4.0 | — | — | — | — | — | — | — |
| Comparative example 2 | FIG. 6A, FIG. 6B | Square > Square | Absent | | | 0.2 | 0.7 | | | — | — | 1.4 | 1.4 | — | — | 30 |
| Example 1 | FIG. 4A, | | Present | | | 0.1 | 0.8 | | | 3.6 | 3.6 | 0.8 | 0.8 | 0.2 | 2 | |
| Example 2 | FIG. 4B | | | | | 0.15 | 0.75 | | | 3.4 | 3.4 | | | 0.3 | | |
| Example 3 | | | | | | 0.2 | 0.7 | | | 3.2 | 3.2 | | | 0.4 | | |
| Example 4 | | | | | | 0.25 | 0.65 | | | 3.0 | 3.0 | | | 0.5 | | |
| Example 5 | | | | | | 0.3 | 0.6 | | | 2.8 | 2.8 | | | 0.6 | | |

| Comparative example/Example | | Parameter/load condition/evaluation item: Load condition 2 (kN) | Principal stress underneath foundation concrete: Point A | Point B | Point C (kN/m²) | Ground contact pressure underneath improved body: Point D | Concrete amount (m³) |
|---|---|---|---|---|---|---|---|
| Comparative example 1 | FIG. 5A, FIG. 5B | Long-term load N = 1100 | 95.6 | 28.4 | 188.4 | 106.4 | 14.4 |
| Comparative example 2 | FIG. 6A, FIG. 6B | Short-term load Q = 220 | 101.6 | 4.4 | 173.7 | 101.6 | 8.7 |
| Example 1 | FIG. 4A, | (I = 3.0 m) | 101.6 | 14.4 | 172.5 | 99.1 | 6.0 |
| Example 2 | FIG. 4B | | 101.2 | 19.4 | 165.9 | 99.5 | 6.1 |
| Example 3 | | | 100.8 | 22.4 | 165.9 | 99.9 | 6.3 |
| Example 4 | | | 100.2 | 24.0 | 165.1 | 100.3 | 6.6 |
| Example 5 | | | 99.8 | 25.1 | 158.9 | 100.7 | 6.9 |

Table 3 is provided below:

TABLE 3

| Comparative example/Example | | Shape of foundation concrete: "Plan shape" "Bottom surface shape" (Magnitude relation) | Presence/ absence of brim portion | Parameter/load condition/evaluation item: L | H | H1 | H2 | B1 | W1 | B2 | W2 | B3 | W3 | E | E/H1 | α (°) |
|---|---|---|---|---|---|---|---|---|---|---|---|---|---|---|---|---|
| | | | | (m) | | | | | | | | | | | | |
| Comparative example 1 | FIG. 5A, FIG. 5B | Square = Square | Absent | 2.5 | 0.9 | — | — | 4.0 | 4.0 | — | — | — | — | — | — | — |
| Comparative example 2 | FIG. 6A, FIG. 6B | Square > Square | Absent | | | 0.2 | 0.7 | | | — | — | 1.4 | 1.4 | — | — | 30 |
| Example 1 | FIG. 4A, | | Present | | | 0.1 | 0.8 | | | 3.6 | 3.6 | 0.8 | 0.8 | 0.2 | 2 | |
| Example 2 | FIG. 4B | | | | | 0.15 | 0.75 | | | 3.4 | 3.4 | | | 0.3 | | |
| Example 3 | | | | | | 0.2 | 0.7 | | | 3.2 | 3.2 | | | 0.4 | | |
| Example 4 | | | | | | 0.25 | 0.65 | | | 3.0 | 3.0 | | | 0.5 | | |
| Example 5 | | | | | | 0.3 | 0.6 | | | 2.8 | 2.8 | | | 0.6 | | |

TABLE 3-continued

| Comparative example/Example | | Parameter/load condition/evaluation item | | | | | |
|---|---|---|---|---|---|---|---|
| | | Load condition 3 (kN) | Principal stress underneath foundation concrete | | | Ground contact pressure underneath improved body | Concrete amount ($m^3$) |
| | | | Point A | Point B | Point C ($kN/m^2$) | Point D | |
| Comparative example 1 | FIG. 5A, FIG. 5B | Long-term load N = 1100 | 90.0 | 0.5 | 281.0 | 104.0 | 14.4 |
| Comparative example 2 | FIG. 6A, FIG. 6B | Short-term load Q = 440 | 84.2 | 0.2 | 313.0 | 96.8 | 8.7 |
| Example 1 | FIG. 4A, | (I = 3.0 m) | 82.0 | 0.1 | 288.7 | 94.9 | 6.0 |
| Example 2 | FIG. 4B | | 81.2 | 0.9 | 271.7 | 95.8 | 6.1 |
| Example 3 | | | 80.5 | 1.2 | 270.1 | 96.5 | 6.3 |
| Example 4 | | | 79.9 | 1.4 | 265.8 | 97.1 | 6.6 |
| Example 5 | | | 80.2 | 1.1 | 252.4 | 97.7 | 6.9 |

In Table 1 showing the analysis result for the load condition 1 in which the horizontal force and the moment load are not applied, the values of the principal stresses (point B) underneath the foundation concrete and the principal stresses (point C) underneath the foundation concrete, which are symmetric with respect to the load N, are different from each other. The reason is that, when mesh division of the analysis domain is automatically performed with the ground FEM analysis software, the mesh around the point B and the mesh around the point C are not symmetric. Since the difference between the principal stresses at the point B and the principal stresses at the point C is not greater than 1%, it is considered that there is no problem with analysis accuracy.

Figure 7A:
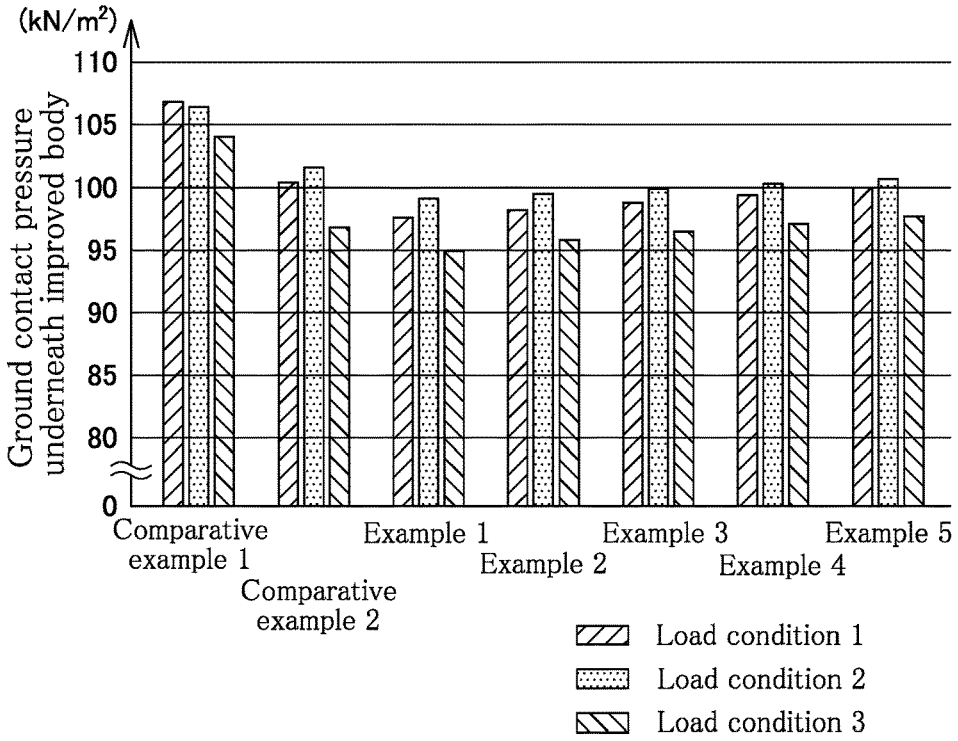
FIG. 7A is a graph showing ground contact pressures underneath (point D) improved bodies in Comparative examples 1 and 2 and Examples 1 to 5.
Figure 7B:
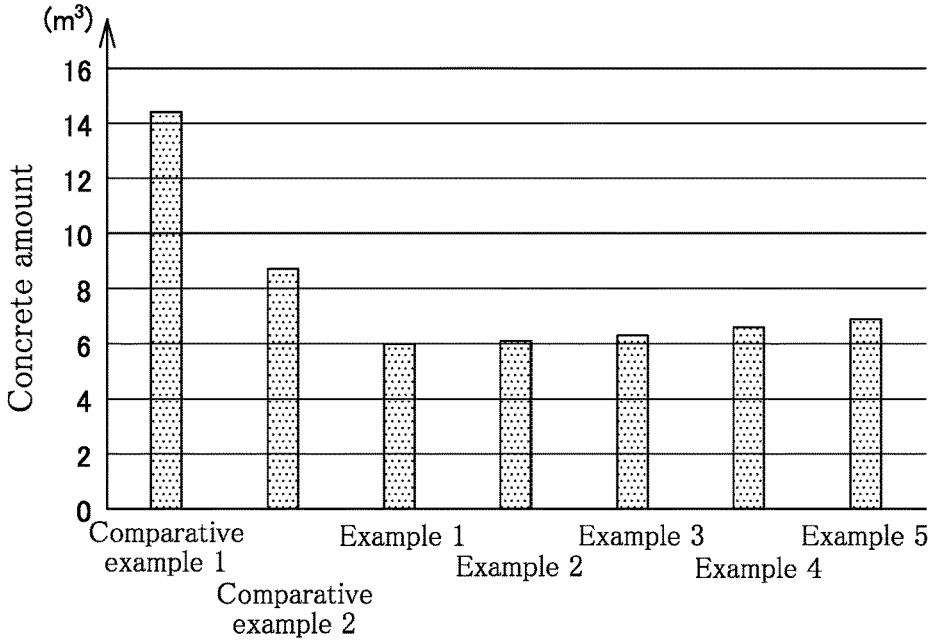
FIG. 7B is a graph showing concrete amounts in Comparative examples 1 and 2 and Examples 1 to 5.

The ground contact pressures (point D) underneath the improved bodies in Comparative examples 1 and 2 and Examples 1 to 5 are shown as a graph in FIG. 7A, and the concrete amounts in Comparative examples 1 and 2 and Examples 1 to 5 are shown as a graph in FIG. 7B.

From the graph in FIG. 7A, it is found that the ground contact pressure underneath the improved body is smaller in Examples 1 to 5 than that in Comparative example 1. In addition, the ground contact pressure underneath the improved body is generally smaller in Examples 1 to 5 than that in Comparative example 2 (in the load condition 3, Comparative example 2 indicates 96.8 $kN/m^2$, Example 4 indicates 97.1 $kN/m^2$, and Example 5 indicates 97.7 $kN/m^2$, i.e., the ground contact pressure is slightly greater in Examples 4 and 5 than that in Comparative example 2).

For example, in the load condition 1, the ground contact pressure (point D) underneath the improved body in Example 1 (97.6 $kN/m^2$) is about 91% of that in Comparative example 1 (106.8 $kN/m^2$), and is about 97% of that in Comparative example 2 (100.4 $kN/m^2$). In addition, in the load condition 2, the ground contact pressure (point D) underneath the improved body in Example 1 (99.1 $kN/m^2$) is about 93% of that in Comparative example 1 (106.4 $kN/m^2$), and is about 98% of that in Comparative example 2 (101.6 $kN/m^2$). Further, in the load condition 3, the ground contact pressure (point D) underneath the improved body in Example 1 (94.9 $kN/m^2$) is about 91% of that in Comparative example 1 (104.0 $kN/m^2$), and is about 98% of that in Comparative example 2 (96.8 $kN/m^2$).

The reason why the ground contact pressure underneath the improved body can be reduced in Examples as described above is considered as follows. Owing to the shape (FIG. 4A and FIG. 4B) of the foundation concrete 3 in Examples, the range in which stress is transferred from the foundation concrete 3 to the lower ground is broadened, and thus stress transferred to the lower ground can be reduced.

From the graph in FIG. 7B, it is found that the concrete amount can be made smaller in Examples 1 to 5 than in Comparative examples 1 and 2. The reason is that the volume of the foundation concrete 3 is reduced owing to the shape (FIG. 4A and FIG. 4B) of the foundation concrete 3 in Examples 1 to 5.

For example, the concrete amount (6.0 $m^3$) in Example 1 is about 42% of that in Comparative example 1 (14.4 $m^3$) and is about 69% of that in Comparative example 2 (8.7 $m^3$).

In a case where the horizontal load Q is applied to the foundation concrete 3 as in the load conditions 2 and 3, a moment load is applied to the foundation concrete 3. As a result, the principal stresses at the point C which is one end underneath the foundation concrete increases, so that the maximum ground contact pressure is applied at the point C.

For example, regarding the principal stresses at the point C underneath the foundation concrete in Table 2 corresponding to the load condition 2, Comparative example 1 having no brim portion indicates 188.4 $kN/m^2$, whereas Comparative example 2 having no brim portion indicates a smaller value of 173.7 $kN/m^2$, and Examples 1 to 5 having the brim portion indicate even smaller values of 172.5 $kN/m^2$ to 158.9 $kN/m^2$.

In addition, regarding the principal stresses at the point C underneath the foundation concrete in Table 3 corresponding to the load condition 3, Comparative example 1 having no brim portion indicates 281.0 $kN/m^2$, whereas Comparative example 2 having no brim portion indicates 313.0 $kN/m^2$. Thus, the value in Comparative example 2 is greater than that in Comparative example 1.

On the other hand, Examples 1 to 5 having the brim portion indicate 288.7 $kN/m^2$ to 252.4 $kN/m^2$. The value in Example 1 (288.7 $kN/m^2$) is slightly greater than that in Comparative example 1 (281.0 $kN/m^2$), but the values in Example 2 (271.7 $kN/m^2$) to Example 5 (252.4 $kN/m^2$) are smaller than those in Comparative example 1 (281.0 $kN/m^2$) and Comparative example 2 (313.0 $kN/m^2$). In particular, the values in Examples 1 to 5 are significantly smaller than that in Comparative example 2. For example, the value in Example 1 (288.7 $kN/m^2$) is about 92% of that in Comparative example 2 (313.0 $kN/m^2$), and the value in Example 5 (252.4 $kN/m^2$) is about 81% of that in Comparative example 2 (313.0 $kN/m^2$).

As described above, when the moment load is applied to the foundation concrete 3, the maximum ground contact pressure applied to one end underneath the foundation concrete 3 can be reduced in the foundation concrete in Examples 1 to 5 having the brim portion. The reason is that the ground contact pressure at the end (point C) of the foundation concrete 3 is dispersed owing to presence of the brim portion (e.g., F1 in FIG. 4B).

Second Analysis

A. Parameters (1) The improvement thickness L is set to 2.5 m, the secondary improvement thickness J is set to 1.0 m, and the primary improvement width K is set to 5.6 m.

(2) The height H2 of the foundation lower part is set to 0.8 m, and the foundation transverse width B1 and the foundation longitudinal width W1 are set to 4.0 m.

(3) B2 and W2 are set to 3.6 m, and E is set to 0.2 m.

(4) The slope angle α of the slope surface S1 (the side surface of the reverse trapezoidal sectional shape) from the horizontal plane is set to about 30°.

(5) The transverse width B3 of the foundation bottom surface B S1 and the longitudinal width W3 of the foundation bottom surface B S1 are set to 0.8 m.

The values of H1 and E/H1 are set as follows.

(1) Example 6: H1=0.2 m, E/H1=1

(2) Example 7: H1=0.15 m, E/H1≈1.3

(3) Example 1: H1=0.1 m, E/H1=2

(4) Example 8: H1=0.05 m, E/H1=4

B. Load Conditions and Evaluation Items

The same load conditions 1 to 3 and evaluation items as those in the first analysis are applied.

C. Analysis Result

Figure 8A:
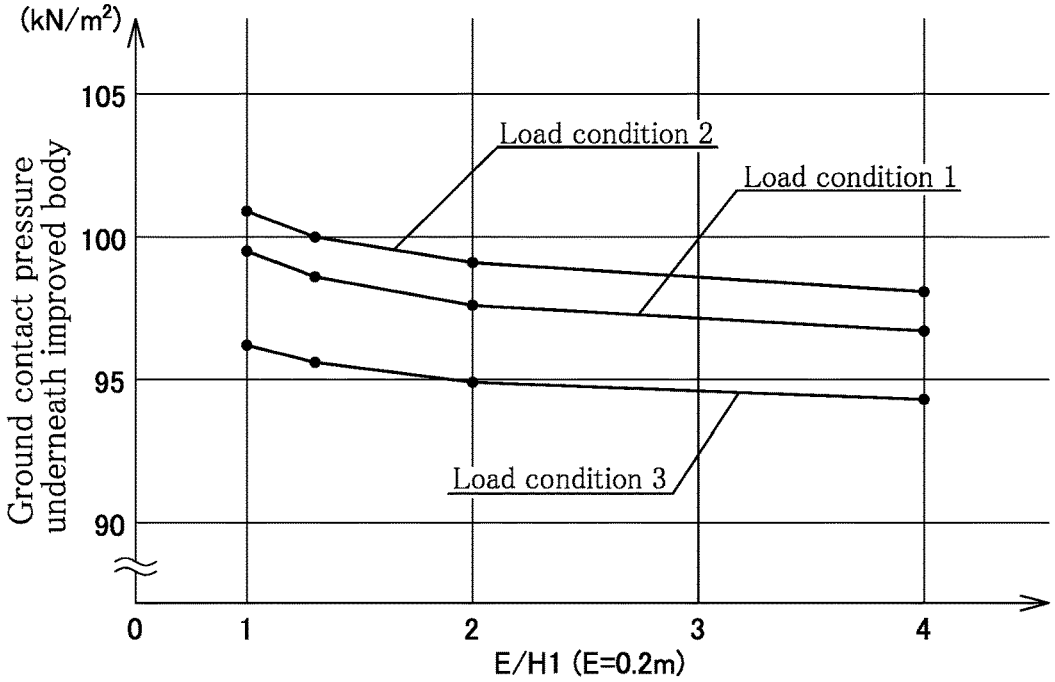
FIG. 8A is a graph showing change in the ground contact pressure underneath (point D) the improved body with E/H1 (E=0.2 m).
Figure 9A:
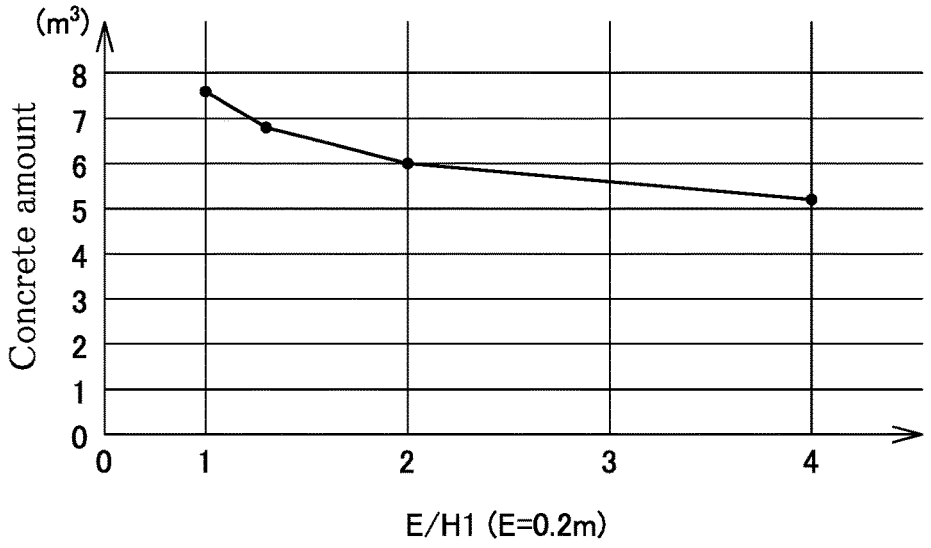
FIG. 9A is a graph showing change in the concrete amount with E/H1 (E=0.2 m).

Table 4 shows an analysis result. FIG. 8A shows a graph with E/H1 set on the horizontal axis and the ground contact pressure (point D) underneath the improved body set on the vertical axis, and FIG. 9A shows a graph with E/H1 set on the horizontal axis and the concrete amount set on the vertical axis.

Table 4 is provided below:

TABLE 4

| Example | Shape of foundation concrete: "Plan shape" / "Bottom surface shape" (Magnitude relation) | Presence/ absence of brim portion | Parameter/load condition/evaluation item: L (m) | H (m) | H1 (m) | H2 (m) | B1 (m) | W1 (m) | B2 (m) | W2 (m) | B3 (m) | W3 (m) | E (m) | E/H1 | α (°) |
|---|---|---|---|---|---|---|---|---|---|---|---|---|---|---|---|
| Example 6 FIG. 4A, | Square > Square | Present | 2.5 | 1.0 | 0.2 | 0.8 | 4.0 | 4.0 | 3.6 | 3.6 | 0.8 | 0.8 | 0.2 | 1 | 30 |
| Example 7 FIG. 4B | | | | 0.95 | | | | | | | | | | 1.3 | |
| Example 1 | | | | 0.9 | | | | | | | | | | 2 | |
| Example 8 | | | | 0.85 | | | | | | | | | | 4 | |
| Example 6 FIG. 4A, | Square > Square | Present | 2.5 | 1.0 | 0.2 | 0.8 | 4.0 | 4.0 | 3.6 | 3.6 | 0.8 | 0.8 | 0.2 | 1 | 30 |
| Example 7 FIG. 4B | | | | 0.95 | | | | | | | | | | 1.3 | |
| Example 1 | | | | 0.9 | | | | | | | | | | 2 | |
| Example 8 | | | | 0.85 | | | | | | | | | | 4 | |
| Example 6 FIG. 4A, | Square > Square | Present | 2.5 | 1.0 | 0.2 | 0.8 | 4.0 | 4.0 | 3.6 | 3.6 | 0.8 | 0.8 | 0.2 | 1 | 30 |
| Example 7 FIG. 4B | | | | 0.95 | | | | | | | | | | 1.3 | |
| Example 1 | | | | 0.9 | | | | | | | | | | 2 | |
| Example 8 | | | | 0.85 | | | | | | | | | | 4 | |

| Example | Parameter/load condition/evaluation item: Load condition | Principal stress underneath foundation concrete: Point A (kN/m²) | Point B (kN/m²) | Point C (kN/m²) | Ground contact pressure underneath improved body: Point D (kN/m²) | Concrete amount (m³) |
|---|---|---|---|---|---|---|
| Example 6 FIG. 4A, | 1 | 103.8 | 93.2 | 94.3 | 99.5 | 7.6 |
| Example 7 FIG. 4B | | 102.7 | 94.4 | 97.2 | 98.6 | 6.8 |
| Example 1 | | 101.4 | 92.7 | 93.4 | 97.6 | 6.0 |
| Example 8 | | 100.2 | 90.1 | 91.3 | 96.7 | 5.2 |
| Example 6 FIG. 4A, | 2 | 104.1 | 12.2 | 176.4 | 100.9 | 7.6 |
| Example 7 FIG. 4B | | 103.0 | 13.2 | 174.9 | 100.0 | 6.8 |
| Example 1 | | 101.6 | 14.4 | 172.5 | 99.1 | 6.0 |
| Example 8 | | 100.4 | 15.6 | 167.2 | 98.1 | 5.2 |
| Example 6 FIG. 4A, | 3 | 84.2 | 0.1 | 299.2 | 96.2 | 7.6 |
| Example 7 FIG. 4B | | 83.5 | 0.1 | 294.9 | 95.6 | 6.8 |
| Example 1 | | 82.0 | 0.1 | 288.7 | 94.9 | 6.0 |
| Example 8 | | 80.7 | 0.3 | 278.7 | 94.3 | 5.2 |

In the case where the protruding length E of the brim portion F1 is fixed (E=0.2 m) and the ratio (E/H1) of the protruding length E of the brim portion F1 to the thickness H1 of the brim portion F1 is changed, it is found that, the greater the ratio (E/H1) is, i.e., the smaller the thickness H1 of the brim portion F1 is, the smaller the ground contact pressure (point D) underneath the improved body and the concrete amount are.

Third Analysis

A. Parameters (1) The improvement thickness L is set to 2.5 m, the secondary improvement thickness J is set to 1.0 m, and the primary improvement width K is set to 5.6 m.

(2) The foundation height H is set to 0.9 m, the height H1 of the foundation upper part is set to 0.1 m, and the height H2 of the foundation lower part is set to 0.8 m.

(3) The foundation transverse width B1 and the foundation longitudinal width W1 are set to 4.0 m.

(4) The slope angle α of the slope surface S1 (the side surface of the reverse trapezoidal sectional shape) from the horizontal plane is set to about 30°.

The values of B2 that is equal to W2, B3 that is equal to W3, E, and E/H1 are set as follows.

(1) Example 9: B2=W2=3.8 m, B3=W3=1.0 m, E=0.1 m, E/H1=1

(2) Example 10: B2=W2=3.7 m, B3=W3=0.9 m, E=0.15 m, E/H1=1.5

(3) Example 1: B2=W2=3.6 m, B3=W3=0.8 m, E=0.2 m, E/H1=2

(4) Example 11: B2=W2=3.5 m, B3=W3=0.7 m, E=0.25 m, E/H1=2.5

(5) Example 12: B2=W2=3.4 m, B3=W3=0.6 m, E=0.3 m, E/H1=3

(6) Example 13: B2=W2=3.2 m, B3=W3=0.4 m, E=0.4 m, E/H1=4

B. Load Conditions and Evaluation Items

The same load conditions 1 to 3 and evaluation items as those in the first analysis are applied.

C. Analysis Results

Figure 8B:
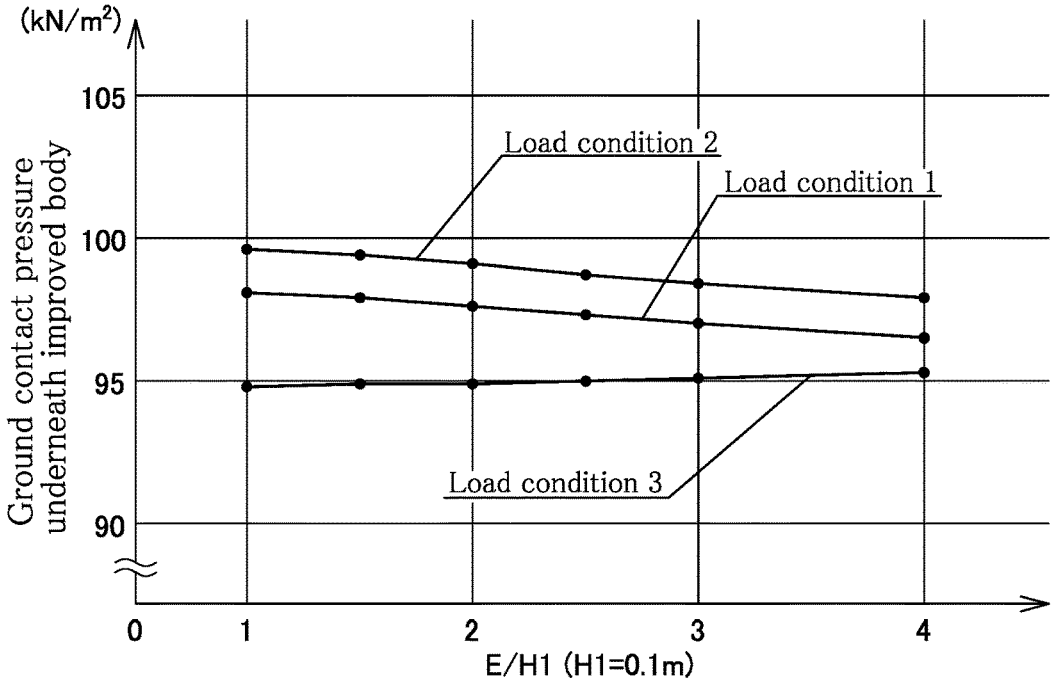
FIG. 8B is a graph showing change in the ground contact pressure underneath (point D) the improved body with E/H1 (H1=0.1 m).
Figure 9B:
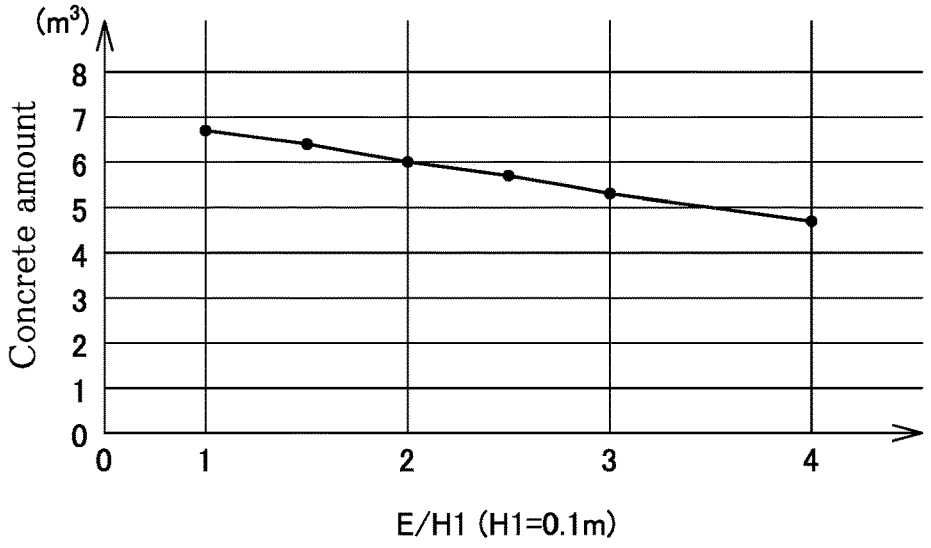
FIG. 9B is a graph showing change in the concrete amount with E/H1 (H1=0.1 m).

Table 5 shows an analysis result. FIG. 8B shows a graph with E/H1 set on the horizontal axis and the ground contact pressure (point D) underneath the improved body set on the vertical axis, and FIG. 9B shows a graph with E/H1 set on the horizontal axis and the concrete amount set on the vertical axis.

Table 5 is provided below:

TABLE 5

| Example | | Shape of foundation concrete: "Plan shape" "Bottom surface shape" (Magnitude relation) | Presence/ absence of brim portion | Parameter/load condition/evaluation item: L | H | H1 | H2 | B1 | W1 | B2 (m) | W2 | B3 | W3 | E | E/H1 | α (°) |
|---|---|---|---|---|---|---|---|---|---|---|---|---|---|---|---|---|
| Example 9 | FIG. 4A, | Square > Square | Present | 2.5 | 0.9 | 0.1 | 0.8 | 4.0 | 4.0 | 3.8 | 3.8 | 1.0 | 1.0 | 0.1 | 1 | 30 |
| Example 10 | FIG. 4B | | | | | | | | | 3.7 | 3.7 | 0.9 | 0.9 | 0.15 | 1.5 | |
| Example 1 | | | | | | | | | | 3.6 | 3.6 | 0.8 | 0.8 | 0.2 | 2 | |
| Example 11 | | | | | | | | | | 3.5 | 3.5 | 0.7 | 0.7 | 0.25 | 2.5 | |
| Example 12 | | | | | | | | | | 3.4 | 3.4 | 0.6 | 0.6 | 0.3 | 3 | |
| Example 13 | | | | | | | | | | 3.2 | 3.2 | 0.4 | 0.4 | 0.4 | 4 | |
| Example 9 | FIG. 4A, | Square > Square | Present | 2.5 | 0.9 | 0.1 | 0.8 | 4.0 | 4.0 | 3.8 | 3.8 | 1.0 | 1.0 | 0.1 | 1 | 30 |
| Example 10 | FIG. 4B | | | | | | | | | 3.7 | 3.7 | 0.9 | 0.9 | 0.15 | 1.5 | |
| Example 1 | | | | | | | | | | 3.6 | 3.6 | 0.8 | 0.8 | 0.2 | 2 | |
| Example 11 | | | | | | | | | | 3.5 | 3.5 | 0.7 | 0.7 | 0.25 | 2.5 | |
| Example 12 | | | | | | | | | | 3.4 | 3.4 | 0.6 | 0.6 | 0.3 | 3 | |
| Example 13 | | | | | | | | | | 3.2 | 3.2 | 0.4 | 0.4 | 0.4 | 4 | |
| Example 9 | FIG. 4A, | Square > Square | Present | 2.5 | 0.9 | 0.1 | 0.8 | 4.0 | 4.0 | 3.8 | 3.8 | 1.0 | 1.0 | 0.1 | 1 | 30 |
| Example 10 | FIG. 4B | | | | | | | | | 3.7 | 3.7 | 0.9 | 0.9 | 0.15 | 1.5 | |
| Example 1 | | | | | | | | | | 3.6 | 3.6 | 0.8 | 0.8 | 0.2 | 2 | |
| Example 11 | | | | | | | | | | 3.5 | 3.5 | 0.7 | 0.7 | 0.25 | 2.5 | |
| Example 12 | | | | | | | | | | 3.4 | 3.4 | 0.6 | 0.6 | 0.3 | 3 | |
| Example 13 | | | | | | | | | | 3.2 | 3.2 | 0.4 | 0.4 | 0.4 | 4 | |

| Example | | Parameter/load condition/evaluation item: Load condition | Principal stress underneath foundation concrete: Point A | Point B | Point C (kN/m²) | Ground contact pressure underneath improved body: Point D | Concrete amount (m³) |
|---|---|---|---|---|---|---|---|
| Example 9 | FIG. 4A, | 1 | 101.7 | 94.2 | 91.9 | 98.1 | 6.7 |
| Example 10 | FIG. 4B | | 101.6 | 93.7 | 92.2 | 97.9 | 6.4 |
| Example 1 | | | 101.4 | 92.7 | 93.4 | 97.6 | 6.0 |
| Example 11 | | | 101.3 | 91.8 | 91.9 | 97.3 | 5.7 |
| Example 12 | | | 101.2 | 91.3 | 91.6 | 97.0 | 5.3 |
| Example 13 | | | 101.0 | 92.7 | 91.0 | 96.5 | 4.7 |
| Example 9 | FIG. 4A, | 2 | 102.0 | 6.6 | 177.5 | 99.6 | 6.7 |
| Example 10 | FIG. 4B | | 101.7 | 10.7 | 174.0 | 99.4 | 6.4 |
| Example 1 | | | 101.6 | 14.4 | 172.5 | 99.1 | 6.0 |
| Example 11 | | | 101.6 | 18.0 | 165.9 | 98.7 | 5.7 |
| Example 12 | | | 101.4 | 20.5 | 163.0 | 98.4 | 5.3 |
| Example 13 | | | 101.1 | 24.4 | 157.8 | 97.9 | 4.7 |
| Example 9 | FIG. 4A, | 3 | 81.8 | 0.05 | 314.1 | 94.8 | 6.7 |
| Example 10 | FIG. 4B | | 81.9 | 0.02 | 298.2 | 94.9 | 6.4 |
| Example 1 | | | 82.0 | 0.1 | 288.7 | 94.9 | 6.0 |
| Example 11 | | | 81.5 | 0.4 | 275.0 | 95.0 | 5.7 |

TABLE 5-continued

| | | | | | |
|---|---|---|---|---|---|
| Example 12 | 80.6 | 0.9 | 268.5 | 95.1 | 5.3 |
| Example 13 | 79.4 | 1.5 | 256.0 | 95.3 | 4.7 |

In the case where the thickness H1 of the brim portion F1 is fixed (H1=0.1 m) and the ratio (E/H1) of the protruding length E of the brim portion F1 to the thickness H1 of the brim portion F1 is changed, it is found that, the greater the ratio (E/H1) is, i.e., the greater the protruding length E of the brim portion F1 is, the smaller the concrete amount is.

It is found that, as the ratio (E/H1) increases, i.e., as the protruding length E of the brim portion F1 increases, the ground contact pressure (point D) underneath the improved body decreases in the load conditions 1 and 2, and slightly increases in the load condition 3.

Consideration about Ratio (E/H1)

Through the second analysis and the third analysis, it is found that reducing the thickness H1 of the brim portion F1 and increasing the protruding length E of the brim portion F1 increases the value of (E/H1) and thus provides an effect of reducing the ground contact pressure (point D) underneath the improved body and an effect of reducing the concrete amount.

However, if the thickness H1 of the brim portion F1 is reduced, the tolerable proof stress (born by reinforcing bars and concrete) of the brim portion F1 is reduced, and if the protruding length E of the brim portion F1 increases, the load stress (bending moment and shear force) on the brim portion F1 increases.

Therefore, in order to make the load stress smaller than the tolerable proof stress, the value range of the thickness H1 of the brim portion F1 and the value range of the protruding length E of the brim portion F1 are limited.

That is, it is preferable that the thickness H1 of the brim portion F1 is not less than 0.05 m (e.g., Example 8) and not greater than 0.3 m (e.g., Example 5). In addition, it is preferable that the protruding length E of the brim portion F1 is not less than 0.1 m (e.g., Example 9) and not greater than 0.6 m (e.g., Example 5).

It is preferable that the ratio (E/H1) of the protruding length E of the brim portion F1 to the thickness H1 of the brim portion F1 is not less than 1 and not greater than 4 (e.g., FIG. 9A and FIG. 9B). In this case, the protruding length E of the brim portion F1 is 1 to 4 times the thickness H1 of the brim portion F1.

In the foundation concrete 3 in embodiment 1, the upper part 3A has a rectangular parallelepiped shape and the lower part 3B has a reverse quadrangular frustum shape. The foundation concrete in the present invention is not limited to such a shape.

The foundation concrete 3 which is the individual footing may have any form as long as the foundation concrete 3 has a reverse trapezoidal sectional shape in a cross section taken along the vertical plane including the first horizontal direction O1 perpendicular to the horizontal line connecting the building pillars 4 adjacent to each other, and has the brim portion F1 protruding in the first horizontal direction O1 from the side edge M at the upper end in the sectional shape of the lower part 3B.

Embodiment 2

Figure 10A:
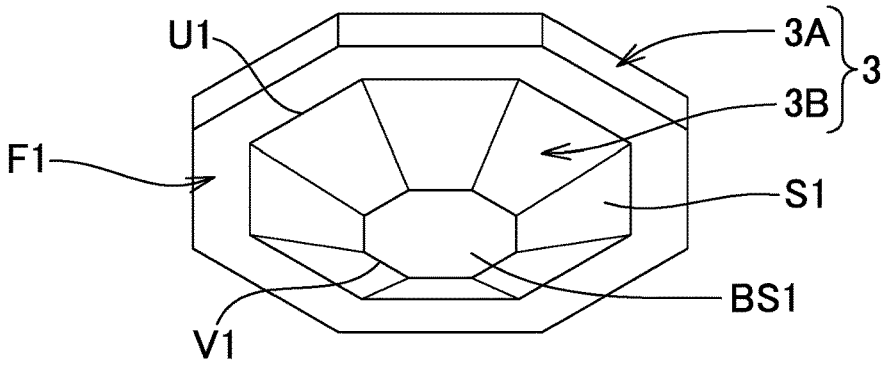
FIG. 10A is a perspective view of foundation concrete in a building foundation structure according to embodiment 2 of the present invention, as seen from below.

Foundation concrete 3 in the building foundation structure according to embodiment 2 of the present invention is shown in a perspective view in FIG. 10A.

In the foundation concrete 3 shown in FIG. 10A, the upper part 3A has an octagonal prism shape, and the lower part 3B has a reverse octagonal frustum shape.

Embodiment 3

Figure 10B:
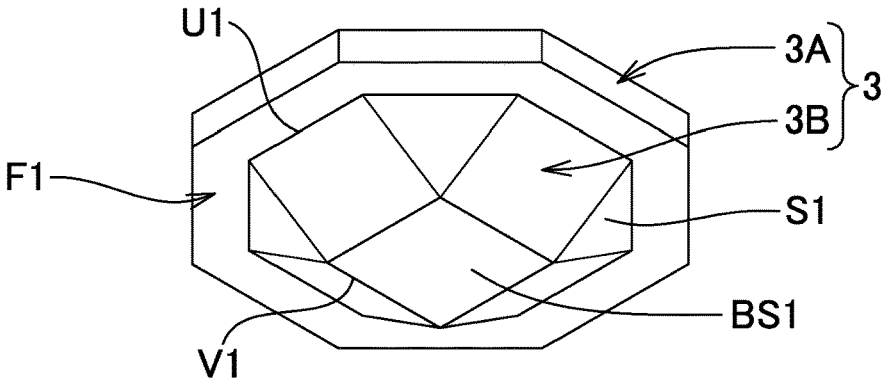
FIG. 10B is a perspective view of foundation concrete in a building foundation structure according to embodiment 3 of the present invention, as seen from below.

Foundation concrete 3 in the building foundation structure according to embodiment 3 of the present invention is shown in a perspective view in FIG. 10B.

In the foundation concrete 3 shown in FIG. 10B, the upper part 3A has an octagonal prism shape, the outer periphery U1 at the upper end of the lower part 3B has a regular octagonal shape, and the outer periphery V1 of the bottom surface BS1 has a square shape.

Embodiment 4

Figure 10C:
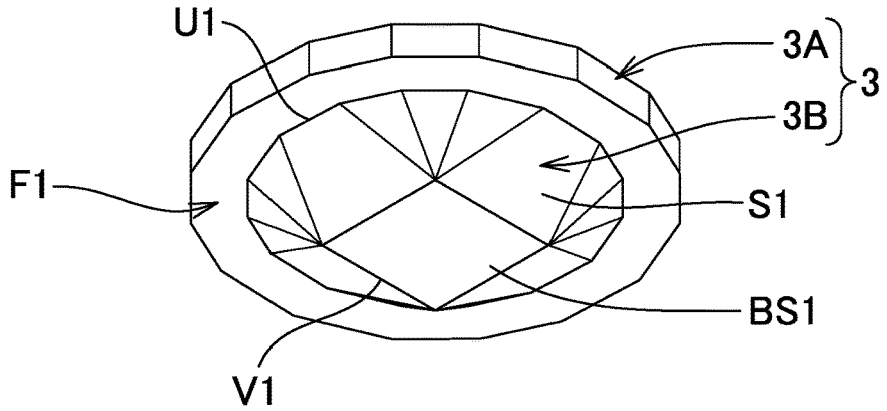
FIG. 10C is a perspective view of foundation concrete in a building foundation structure according to embodiment 4 of the present invention, as seen from below.

Foundation concrete 3 in the building foundation structure according to embodiment 4 of the present invention is shown in a perspective view in FIG. 10C.

In the foundation concrete 3 in FIG. 10C, the upper part 3A has a hexadecagonal prism shape, the outer periphery U1 at the upper end of the lower part 3B has a regular hexadecagonal shape, and the outer periphery V1 of the bottom surface B S1 has a square shape.

Embodiment 5

Figure 11A:
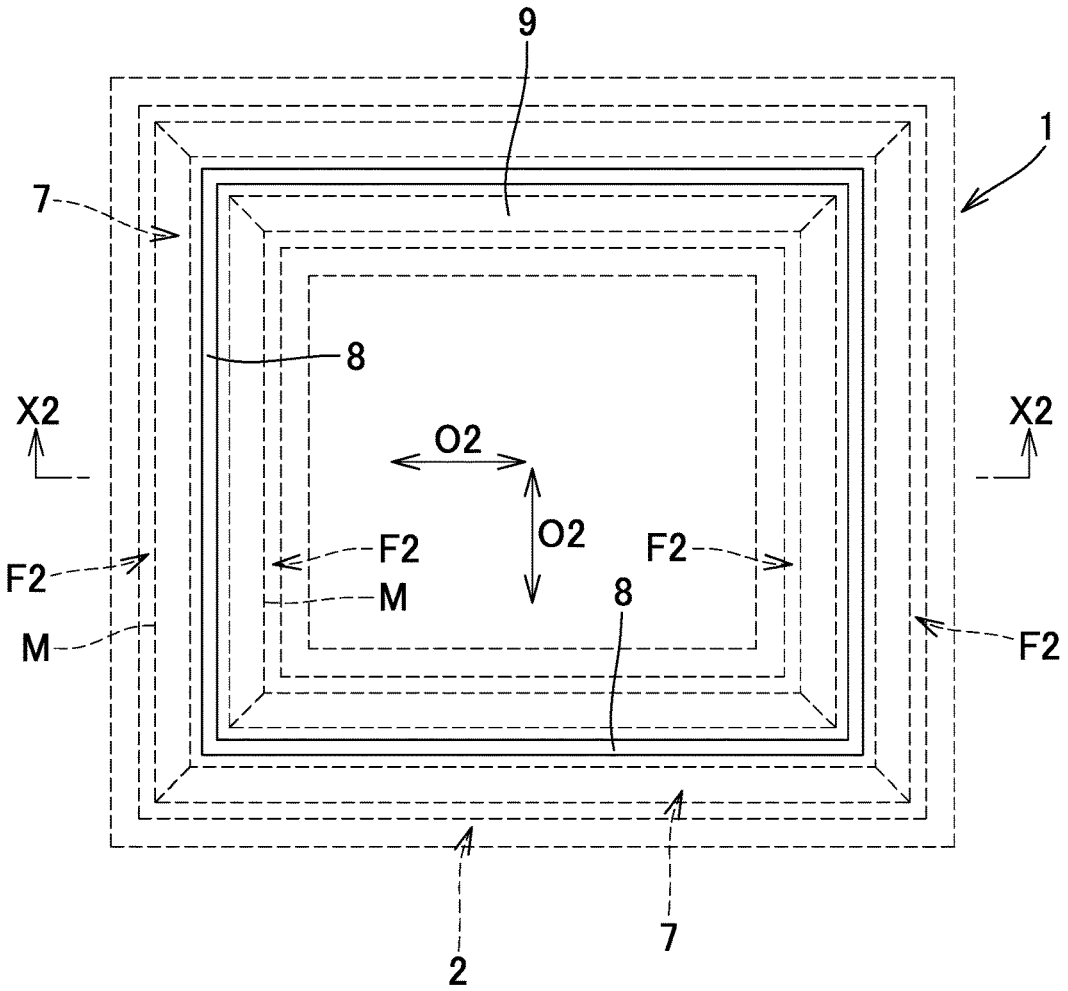
FIG. 11A is a plan view showing a building foundation structure according to embodiment 5 of the present invention.
Figure 11B:
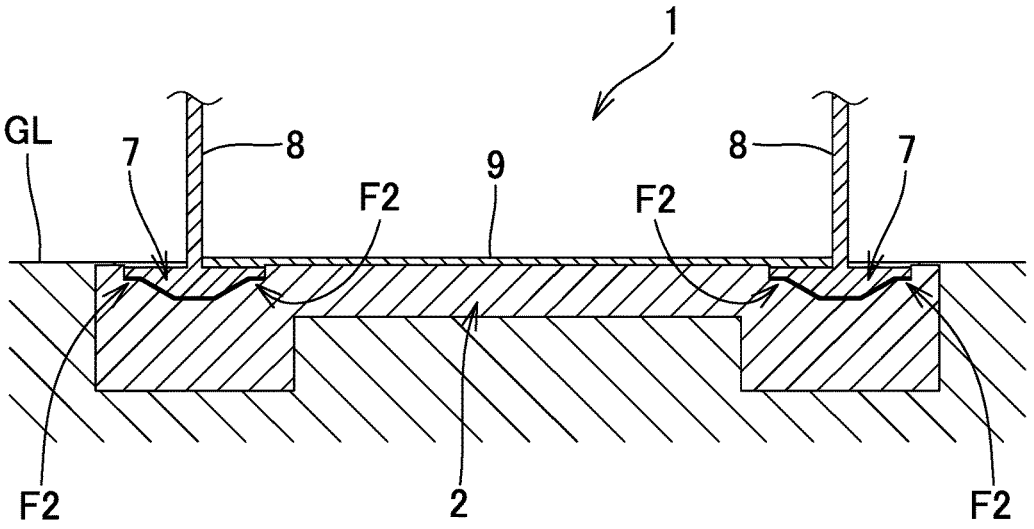
FIG. 11B is a sectional view taken along arrows X2-X2 in FIG. 11A.
Figure 12:
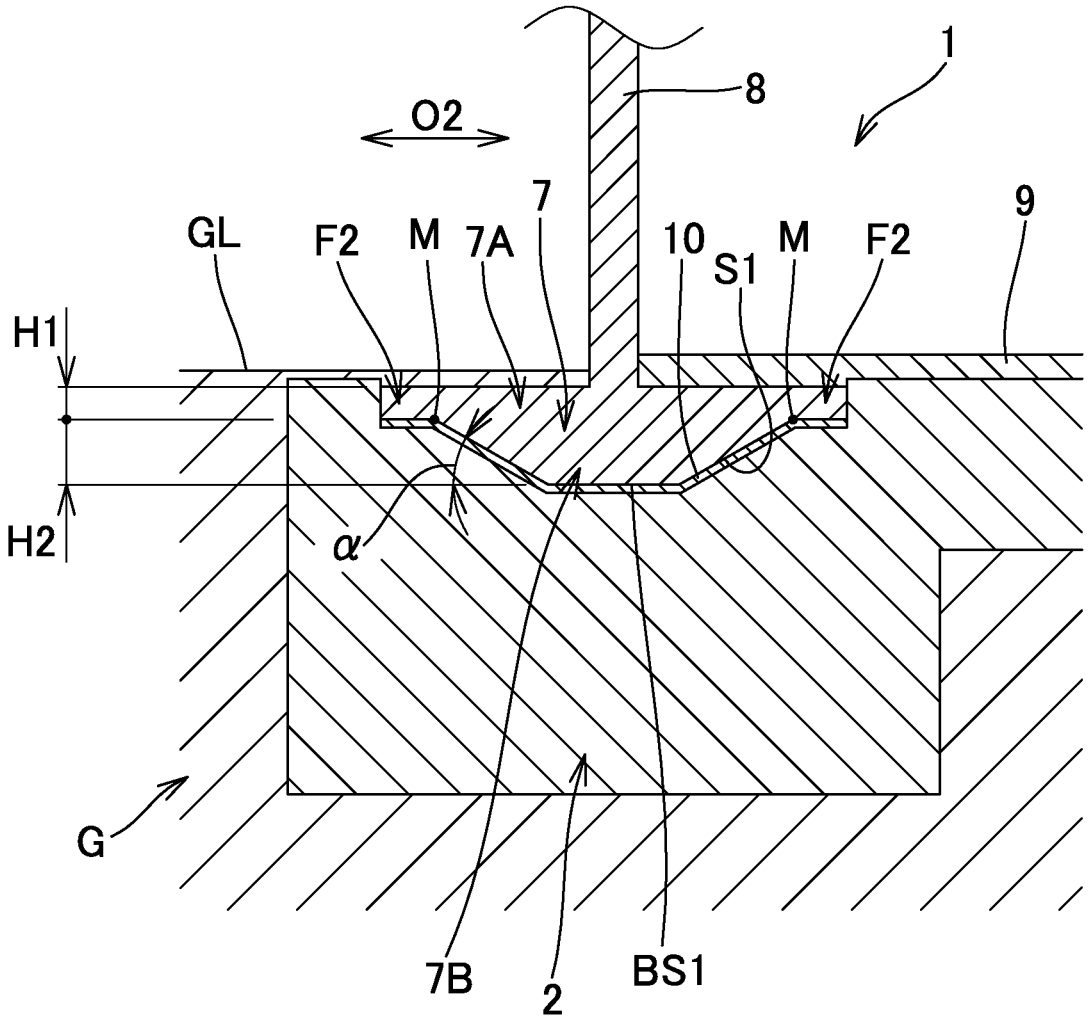
FIG. 12 is an enlarged view of a major part in FIG. 11B.

A plan view in FIG. 11A and sectional views in FIG. 11B and FIG. 12 show a building foundation structure 1 according to embodiment 5 of the present invention.

The building foundation structure 1 includes a ground improved body 2 obtained by improving a surface layer ground G, and foundation concrete 7 placed on the ground improved body 2 on site.

The foundation concrete 7 is continuous footing, and has an upper part 7A and a lower part 7B having shapes different from each other.

The lower part 7B of the foundation concrete 7 has a reverse trapezoidal sectional shape in a cross section taken along a vertical plane including a second horizontal direction O2 perpendicular to a building wall 8. It is preferable that a slope angle $\alpha$ of a side surface S1 in the reverse trapezoidal sectional shape from the horizontal plane is in a range of $20° \leq \alpha \leq 40°$.

The upper part 7A of the foundation concrete 7 has brim portions F2 protruding in the second horizontal direction O2 from side edges M at the upper end in the sectional shape of the lower part 7B.

Next, an example of a construction process for the building foundation 1 will be described.

Ground Improvement Step

A. Dig-down Step

The surface layer ground G below a ground level GL shown in FIG. 11B and FIG. 12 is dug down in a desired shape by, for example, plowing using a backhoe.

B. Primary Improvement Step

Next, a primary improvement step is performed as follows. A backhoe, for example, to which a mixing fork is mounted as an attachment, is used to perform excavation on the ground into a square shape which corresponds to the lower-part shape of the ground improved body 2. Then, mixing and stirring are performed while a solidification material such as a cement-based solidification material is added and mixed, and compaction is performed by a heavy machine and a roller, etc., to form the lower part of the ground improved body 2.

C. Secondary Improvement Step

Next, a secondary improvement step is performed as follows. The soil obtained by digging in the dig-down step is backfilled to the upper side of the lower part of the ground improved body 2 by a backhoe or the like. Then, a backhoe, for example, to which a mixing fork is mounted as an attachment, is used to excavate the surface layer ground G from the ground level GL into the upper-part shape of the ground improved body 2. Then, mixing and stirring are performed while a solidification material is added and mixed, and compaction is performed by a heavy machine and a roller, etc., to form the upper part of the ground improved body 2.

Foundation Excavation Step

A. Upper Excavated Portion Forming Step

Figure 13A:
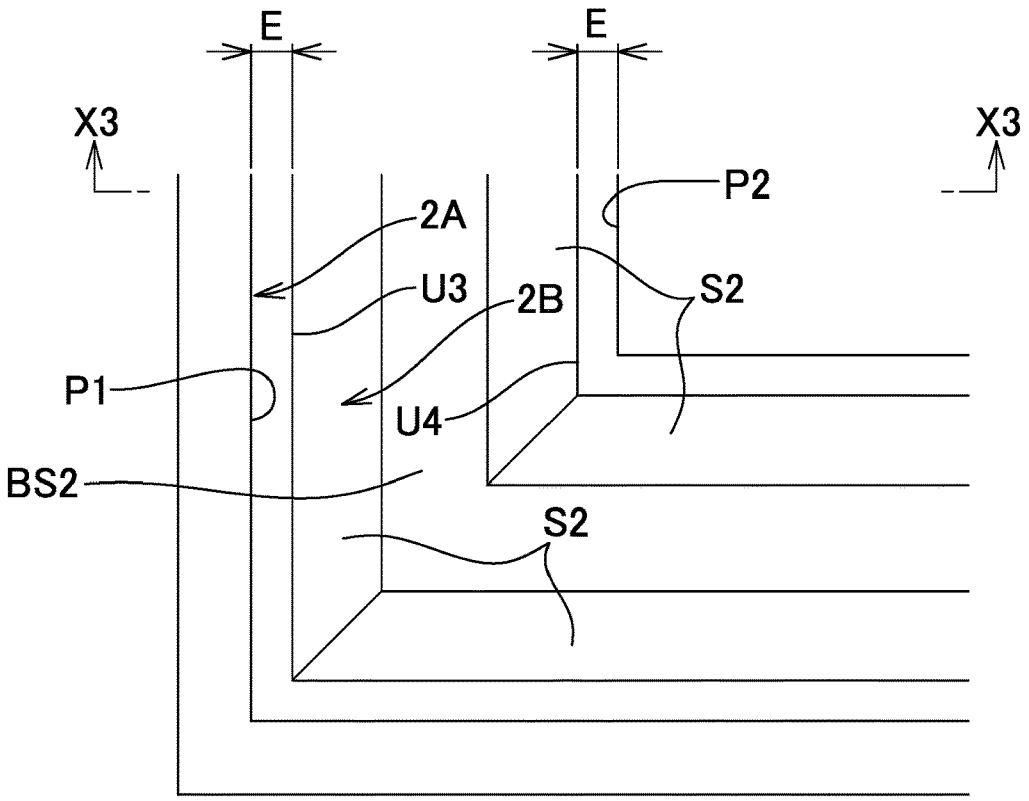
FIG. 13A is a plan view showing a state in which, in a foundation excavation step, an upper excavated portion and a lower excavated portion are formed in a ground improved body formed in a ground improvement step, in a construction method for the building foundation structure according to embodiment 5.
Figure 13B:
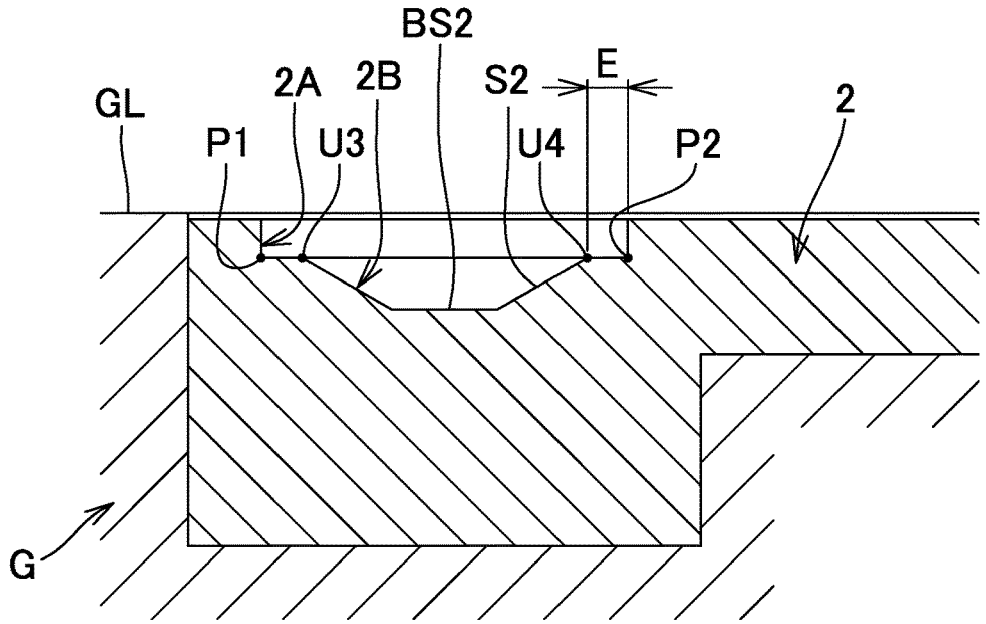
FIG. 13B is a sectional view taken along arrows X3-X3 in FIG. 13A.

Next, with respect to the ground improved body 2 formed in the ground improvement step, the upper part of the ground improved body 2 located below the wall 8 shown in FIG. 11A, FIG. 11B, and FIG. 12 is excavated to positions of lower end outer peripheries P1 and P2, to form an upper excavated portion 2A, as shown in a plan view in FIG. 13A and a sectional view in FIG. 13B.

B. Lower Excavated Portion Forming Step

Next, excavation is performed downward from peripheries U3 and U4 located inward by protruding lengths E of the brim portions F2 from the lower end outer peripheries P1 and P2, to form a lower excavated portion 2B.

Foundation Placing Step

Then, leveling concrete 10 shown in FIG. 12 is placed into the lower excavated portion 2B.

Next, reinforcing bars for the wall 8 are arranged in the leveling concrete 10, foundation reinforcing bar arrangement is performed in the upper excavated portion 2A and the lower excavated portion 2B, and foundation concrete 7 is placed.

Subsequently, the wall 8 which is concrete is placed and floor concrete 9 is placed. The foundation concrete 7 and the wall 8 are connected via the reinforcing bars and thus are integrated.

Through the above process, construction of the building foundation (understructure) 1 shown in FIG. 11A and FIG. 11B is completed.

In the building foundation structure 1 according to the embodiments of the present invention as described above, the foundation concrete 3, 7 placed on site on the ground improved body 2 obtained by improving the surface layer ground G has the upper part 3A, 7A and the lower part 3B, 7B having shapes different from each other. The lower part 3B, 7B has a reverse trapezoidal sectional shape and the upper part 3A, 7A has the brim portion F1, F2 protruding in the horizontal direction.

Owing to the above shape of the foundation concrete 3, 7, the range in which stress is transferred from the foundation concrete 3, 7 to the lower ground is broadened, whereby stress transferred to the lower ground can be reduced, and in addition, the volume of the foundation concrete 3, 7 is reduced, whereby the placing amount of the foundation concrete 3, 7 can be reduced and thus construction cost can be reduced.

Moreover, since the foundation concrete 3, 7 has the brim portion F1, F2, the ground contact pressure at an end of the foundation concrete 3, 7 is dispersed when a moment load is applied to the foundation concrete 3, 7. Thus, the maximum ground contact pressure applied to one end underneath the foundation concrete 3, 7 can be reduced.

The description of the above embodiments is in all aspects illustrative and not restrictive. Various improvements and modifications can be made without departing from the scope of the present invention.

DESCRIPTION OF THE REFERENCE CHARACTERS

1 building foundation structure
2 ground improved body
2A upper excavated portion
2B lower excavated portion
3 foundation concrete (individual footing)
3A upper part
3B lower part
4 steel pillar
5 floor concrete
6 leveling concrete
7 foundation concrete (continuous footing)
7A upper part
7B lower part
8 wall
9 floor concrete
10 leveling concrete
B1 foundation transverse width
B2 transverse width at upper end of lower part
B3 transverse width of foundation bottom surface
BS1, BS2 bottom surface
E protruding length of brim portion
F1, F2 brim portion
G surface layer ground
GL ground level
H foundation height
H1 height of upper part (thickness of brim portion)
H2 height of lower part
J secondary improvement thickness
K primary improvement width
L improvement thickness
M side edge at upper end of lower part
O1 horizontal direction perpendicular to horizontal line connecting pillars
O2 horizontal direction perpendicular to wall
P, P1, P2 lower end outer periphery
S1, S2 side surface
T1, T2 lower surface
U1 outer periphery at upper end of lower part (periphery inward of lower end outer periphery of upper part)
U2 upper end periphery of lower excavated portion (periphery inward of lower end outer periphery of upper excavated portion)
U3, U4 periphery
V1 outer periphery of bottom surface
V2 outer periphery of bottom surface of lower excavated portion
W1 foundation longitudinal width
W2 longitudinal width at upper end of lower part
W3 longitudinal width of foundation bottom surface
α slope angle of side surface which is slope surface from horizontal plane

The invention claimed is:

1. A building foundation structure comprising:

a plurality of foundation concrete structures formed from foundation concrete;

a ground improved body, comprising a compacted solidification material, obtained by improving a surface layer ground, the ground improved body having a shape to define a foundation concrete shape when the foundation concrete is placed into the ground improved body on site, wherein:

the plurality of foundation concrete structures directly supports building steel pillars, each of the plurality of foundation concrete structures has an upper element and a lower element having shapes different from each other, the lower element has a reverse acute trapezoidal sectional shape in a cross section taken along a vertical plane including a horizontal direction perpendicular to a horizontal line connecting adjacent ones of the building steel pillars, the upper element has a brim element protruding in the horizontal direction, from a side edge at an upper end in the sectional shape of the lower element, the brim element disposed directly on the ground improved body, a thickness of the brim element is not less than 0.05 m and not greater than 0.3 m, a protruding length of the brim element is not less than 0.1 m and not greater than 0.6 m, the protruding length of the brim element is 1 to 4 times the thickness of the brim element; and a top surface of the brim element is below or flush with a top surface of the ground improvement body.

2. The building foundation structure according to claim 1, wherein a slope angle of a side surface of the reverse acute trapezoidal sectional shape from a horizontal plane is not less than 20° and not greater than 40°.

3. The building foundation structure according to claim 1, wherein the foundation concrete is individual footing, the lower element has a bottom surface having a four-or-more-sided polygonal shape smaller than a plan shape of an outer periphery at an upper end of the lower element, and the lower element has a side surface which is a slope surface connecting the outer periphery at the upper end of the lower element and an outer periphery of the bottom surface.

4. A construction method for a building foundation structure that includes:

a plurality of foundation concrete structures formed from foundation concrete;

a ground improved body, comprising a compacted solidification material, obtained by improving a surface layer ground, the ground improved body having a shape to define a foundation concrete shape when the foundation concrete is placed into the ground improved body on site, wherein:

the plurality of foundation concrete structures directly supporting building steel pillars, each of the foundation concrete structures having an upper element and a lower element having shapes different from each other, the lower element having a reverse acute trapezoidal sectional shape in a cross section taken along a vertical plane including a horizontal direction perpendicular to a horizontal line connecting the building steel pillars that are adjacent to each other, the upper element having a brim element protruding in the horizontal direction, from a side edge at an upper end in the sectional shape of the lower element, a thickness of the brim element being not less than 0.05 m and not greater than 0.3 m, a protruding length of the brim element being not less than 0.1 m and not greater than 0.6 m, the protruding length of the brim element being 1 to 4 times the thickness of the brim element; and a top surface of the brim element is below or flush with a top surface of the ground improvement body, the construction method comprising a ground improvement step, a foundation excavation step, and a foundation placing step, wherein the ground improvement step is a step of backfilling soil obtained by digging the surface layer ground down, mixing and stirring the soil while adding and mixing a solidification material, and then performing compaction to form the ground improved body, the foundation excavation step includes a step of excavating an upper part of the ground improved body located below a building pillar, into the shape of the upper element of the foundation concrete structure, to form an upper excavated portion, and a step of excavating a part below the upper excavated portion into the shape of the lower element of the foundation concrete structure, to form a lower excavated portion, and the foundation placing step is a step of placing leveling concrete into the lower excavated portion, performing foundation reinforcing bar arrangement in the upper excavated portion and the lower excavated portion, and placing the foundation concrete.

5. The construction method for the building foundation structure according to claim 4, wherein a slope angle of a side surface of the reverse acute trapezoidal sectional shape from a horizontal plane is not less than 20° and not greater than 40°.

6. The building foundation structure according to claim 1, wherein the foundation concrete is supported solely by the ground improved body.

7. A building foundation structure comprising:

a plurality of foundation concrete structures formed from foundation concrete;

a ground improved body, comprising a compacted solidification material, obtained by improving a surface layer ground, the ground improved body having a shape to define a foundation concrete shape when the foundation concrete is placed into the ground improved body on site, wherein:

the plurality of foundation concrete structures directly supports building steel pillars, each of the plurality of foundation concrete structures has an upper element and a lower element having shapes different from each other, the lower element has a reverse acute trapezoidal sectional shape in a cross section taken along a vertical plane including a first horizontal direction perpendicular to a horizontal line connecting the building steel pillars that are adjacent to each other, each side of the lower element extends from a bottom surface of the lower element to an upper periphery of the lower element, each side being acutely angled upward to meet a bottom surface of the upper element;

the upper element has a brim element protruding along an entirety of a width of each of the sides along the upper periphery of the lower element; and a top surface of the brim element is below or flush with a top surface of the ground improvement body.

8. The building foundation structure according to claim 7, wherein a slope angle of a side surface of the reverse acute trapezoidal sectional shape from a horizontal plane is not less than 20° and not greater than 40°.

9. The building foundation structure according to claim 7, wherein the foundation concrete is individual footing, the bottom surface has a four-or-more-sided polygonal shape smaller than a plan shape of an outer periphery at an upper end of the lower element, and the lower element has a side surface which is a slope surface connecting the outer periphery at the upper end of the lower element and an outer periphery of the bottom surface.

10. The building foundation structure according to claim 7, wherein the foundation concrete is supported solely by the ground improved body.

* * * * *